US010413466B2

(12) United States Patent
Finch, Jr. et al.

(10) Patent No.: US 10,413,466 B2
(45) Date of Patent: Sep. 17, 2019

(54) TILT-TIP MOLDABLE TOTAL CARE BED

(71) Applicant: Utopix Medical, LLC, Frisco, TX (US)

(72) Inventors: Charles David Finch, Jr., Flower Mound, TX (US); Scott Goodwin, Farmers Branch, TX (US); Jon Yamamoto, Farmers Branch, TX (US)

(73) Assignee: Utopix Medical, LLC, Frisco, TX (US)

( * ) Notice: Subject to any disclaimer, the term of this patent is extended or adjusted under 35 U.S.C. 154(b) by 0 days.

(21) Appl. No.: 16/196,999

(22) Filed: Nov. 20, 2018

(65) Prior Publication Data

US 2019/0083339 A1 Mar. 21, 2019

Related U.S. Application Data

(63) Continuation of application No. 15/572,944, filed on Nov. 9, 2017, now Pat. No. 10,137,043, and a
(Continued)

(51) Int. Cl.
*A61G 7/057* (2006.01)
*A47C 27/08* (2006.01)
(Continued)

(52) U.S. Cl.
CPC ..... *A61G 7/05738* (2013.01); *A47C 27/086* (2013.01); *A61G 7/00* (2013.01);
(Continued)

(58) Field of Classification Search
CPC ..... A47C 27/08; A47C 27/081; A47C 27/082; A47C 27/083; A47C 27/085;
(Continued)

(56) References Cited

U.S. PATENT DOCUMENTS 4,114,214 A 9/1978 VonHeck
4,498,205 A 2/1985 Hino
(Continued)

FOREIGN PATENT DOCUMENTS

EP 0317009 5/1989

OTHER PUBLICATIONS

Office Action from U.S. Appl. No. 15/808,483 dated Jul. 10, 2018.
(Continued)

*Primary Examiner* — Robert G Santos
(74) *Attorney, Agent, or Firm* — Adsero IP

(57) ABSTRACT

A tilt-tip moldable bed system for the care of immobile patients is provided. The bed system may include a moldable mattress having a casing with a bladder defining an inner volume and a top compliant surface over a top surface of the bladder, the compliant surface configured to conform to a shape of a displacing structure. The bladder may be configured to hold a plurality of beads suspended in a fluid medium. The moldable mattress may be molded while inflated and maintain a resilient shape when evacuated. The system may further include a supporting frame for the moldable support structure having a laterally rigid outer rim with at least one attachment point for the moldable mattress, at least one attachment point for a netted sling, and one or more mounting tracks configured to support at least one peripheral attachment.

14 Claims, 22 Drawing Sheets

Related U.S. Application Data continuation of application No. 15/808,483, filed as application No. PCT/US2017/025336 on Mar. 31, 2017, now Pat. No. 10,130,537, said application No. 15/808,483 is a continuation of application No. PCT/US2017/025336, filed on Mar. 31, 2017.

(60) Provisional application No. 62/316,896, filed on Apr. 1, 2016.

(51) Int. Cl.

| | |
|---|---|
| ***A61G 7/00*** | (2006.01) |
| ***A61G 7/05*** | (2006.01) |
| ***A61G 7/005*** | (2006.01) |
| ***A61G 7/012*** | (2006.01) |
| ***A61G 7/008*** | (2006.01) |
| ***A61G 7/018*** | (2006.01) |

(52) U.S. Cl.

CPC ..... *A61G 7/005* (2013.01); *A61G 7/0005* (2013.01); *A61G 7/008* (2013.01); *A61G 7/012* (2013.01); *A61G 7/018* (2013.01); *A61G 7/05* (2013.01); *A61G 7/057* (2013.01); *A61G 7/0525* (2013.01); *A61G 7/05746* (2013.01); *A61G 7/05753* (2013.01); *A61G 7/05769* (2013.01); *A61G 7/05784* (2016.11)

(58) Field of Classification Search

CPC .. A47C 27/086; A61G 7/057; A61G 7/05738; A61G 7/05746; A61G 7/05753

USPC ..... 5/702, 689, 654, 655.4, 655.5, 644, 911

See application file for complete search history.

(56) References Cited

U.S. PATENT DOCUMENTS

| | | | | |
|---|---|---|---|---|
| 4,564,965 | A | 1/1986 | Goodwin | |
| 4,574,785 | A | 3/1986 | Yamamoto | |
| 4,672,699 | A | 6/1987 | Goodwin | |
| 4,768,250 | A | 9/1988 | Kato | |
| 4,776,050 | A | 10/1988 | Goodwin | |
| 4,879,777 | A | 11/1989 | Goodwin | |
| 4,916,767 | A | 4/1990 | Uetake | |
| 4,995,124 | A | 2/1991 | Wridge, Jr. | |
| 5,001,794 | A | 3/1991 | Uetake | |
| 5,142,717 | A | 9/1992 | Everard | |
| 5,528,782 | A | 6/1996 | Pfeuffer | |
| 6,158,070 | A | 12/2000 | Bolden | |
| 6,694,555 | B2 | 2/2004 | Soltani | |
| 7,784,126 | B2 | 8/2010 | Meissner | |
| 8,216,248 | B2 | 7/2012 | Brown | |
| 8,800,983 | B2 | 8/2014 | Koch | |
| 10,130,537 | B2 | 11/2018 | Finch, Jr. | |
| 10,137,043 | B2 | 11/2018 | Finch, Jr. | |
| 2001/0052152 | A1 | 12/2001 | Soltani | |
| 2004/0158927 | A1 | 8/2004 | Soltani | |
| 2008/0104763 | A1 | 5/2008 | Brown | |
| 2009/0031497 | A1 | 2/2009 | Meissner | |
| 2012/0216350 | A1 | 8/2012 | Koch | |
| 2018/0064594 | A1* | 3/2018 | Finch, Jr. ..... | A61G 7/05784 |
| 2018/0140490 | A1* | 5/2018 | Finch, Jr. ..... | A61G 7/05784 |
| 2019/0083339 | A1* | 3/2019 | Finch, Jr. ..... | A61G 7/05784 |

OTHER PUBLICATIONS

Office Action from U.S. Appl. No. 15/572,944 dated Jul. 10, 2018.

* cited by examiner

600A

1400A

1400C

TILT-TIP MOLDABLE TOTAL CARE BED

RELATED APPLICATIONS

This application is a continuation application of U.S. application Ser. No. 15/808,483, filed Nov. 9, 2017, which is a continuation of International Application No. PCT/US2017/025336 (WO 2017/173248), filed on Mar. 31, 2017, entitled "Tilt-Tip Moldable Total Care Bed", which application claims the benefit of U.S. Provisional Application Ser. No. 62/316,896, filed Apr. 1, 2016, and is also a continuation of U.S. application Ser. No. 15/572,944, filed Nov. 9, 2017, which is a 371 of International Application No. PCT/US2017/025336 (WO 2017/173248), filed on Mar. 31, 2017, entitled "Tilt-Tip Moldable Total Care Bed", which application claims the benefit of U.S. Provisional Application Ser. No. 62/316,896, filed Apr. 1, 2016, each of which is incorporated herein by reference in its entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to hospital beds, and more particularly to a moldable hospital bed capable of movement and rotation to aid caregivers in the movement of patient, as well as for the treatment and prevention of pressure ulcers.

BACKGROUND

Pressure ulcers, also known as bedsores, are a common and serious problem for bedridden and immobilized individuals. Caregivers are often required to regularly adjust the position of these individuals in their beds to prevent the formation of pressure ulcers from prolonged pressure to the same area of the skin. Lifting, turning, and other adjustments of these individual is oftentimes physically demanding, frequently resulting in physical injury to the caregiver.

Typically, pressure ulcers are caused by pressure against the skin, limiting blood flow the skin and surrounding tissues, causing damage to the affected areas. Other contributing factors include friction and shearing forces on the skin, additionally stressing the vulnerable skin and tissues. Furthermore, immobilized individuals must be cleaned and bathed, and have any waste removed. This further requires caregivers to move and turn immobilized individuals in their care. Additionally, because immobilized individuals are unable to change their positions, these individuals may experience discomfort from heat, trapped moisture, and skin contact with the bed surface or sheets.

Conventional hospital beds, wheel chairs, and other similar devices lack functionality to relieve pressure from areas of sustained pressure. Moreover, they lack functionality to assist in bathing and waste removal. The embodiments disclosed herein are directed toward overcoming one or more of the problems discussed above.

BRIEF SUMMARY

Various embodiments provide techniques for implementing a system, method, and/or apparatus for a tilt-tip moldable bed system.

In one embodiment the bed system may utilize a moldable mattress. The moldable mattress may include a casing having a bladder defining an inner volume and a top compliant surface over a top surface of the bladder, the compliant surface being configured to conform to a shape of a displacing structure. The moldable mattress may hold a plurality of beads within the inner volume. The casing may be configured so that the inner volume can be inflated and evacuated with a fluid medium, such that the casing is moldable when inflated, and maintains a resilient shape when an actuating volume of the fluid medium is evacuated. The plurality of beads may be distributed in the fluid medium within the inner volume. In use, with the inner volume of the casing inflated a displacing structure disposed on the compliant surface causes a displacement of at least a portion of the fluid medium and at least a portion of the plurality of beads in the inner volume of the casing and the casing compresses the plurality of beads to maintain a shape of the displacement by the displacing structure when an actuating volume of the fluid medium is evacuated.

According to various embodiments, the plurality of beads may at least one of a closed-cell configuration or a solid polymer bead with substantially no air spaces. In some embodiments, the fluid medium may be non-compressible, and may have a specific gravity greater than the plurality of beads. The plurality of beads may create a gel-like consistency when compressed by evacuation of the actuating volume of fluid medium from the inner volume of the casing.

In some embodiments, the moldable mattress may further include an intermediate layer between the top compliant surface and the top bladder surface, wherein the intermediate layer is configured to define a fluid flow space between the top bladder surface and a displacing structure. The intermediate layer may also be a spandex layer.

In various embodiments, the moldable mattress may be configured to have various shapes. In some embodiments, the mattress, in a plan view, may have a hemispheric egg-shape. In one set of embodiments, the casing may further include an outer skirt attached to and encircling the casing, wherein the outer skirt is configured to be flipped up creating a reservoir around an outer perimeter of the casing above the compliant surface or flipped down. In some embodiment s, the compliant surface of the casing may be expandable in at least one direction. In another embodiment, the casing may be configured to provide recirculation of the fluid medium.

The moldable mattress may further include a mattress fill fluid pump line in fluid communication with the inner volume of the casing, the mattress fill fluid pump line in further communication with a fluid pump. The fluid pump may include least one of a pneumatic pump, hydraulic pump, or a compressible reservoir for the fluid.

In embodiments an evacuation fluid pump line may be provided, and may be operatively associated with the top surface of the bladder for removing fluids from a portion of the fluid flow space between the top surface of the bladder and the top compliant surface underlying a displacing structure disposed on the top compliant surface. The evacuation fluid pump line may further be coupled to a sanitizing trap, wherein the sanitizing trap holds a sanitizing and deodorizing solution.

In further embodiments, the compliant surface may have a shore A durometer less than 10, or may have an elongation factor of at least 300%. The casing may further include a gusseted sleeve having a fastening bungee configured to an attachment point of a supporting frame.

In some further embodiments, the casing may also include an evacuation header having one or more fluid pump line interfaces configured to couple to one or more fluid pump lines. The evacuation header may include an inner chamber for holding liquid drained from the top compliant surface of the mattress and one or more evacuation tubes configured to drain fluid from the top surface of the bladder to the inner chamber. In some embodiments, the evacuation header may further include a ventilation chamber in fluid communication with an air fluid pump line interface, the ventilation chamber configured to provide ventilation to the top surface of the bladder.

Another embodiment is a supporting frame for supporting a moldable mattress. The supporting frame may include a laterally rigid outer rim having at least one attachment point for a moldable mattress, at least one attachment point for a netted sling, and one or more mounting tracks configured to support at least one peripheral attachment. The supporting frame may also be expandable, having an expansion joint. The expansion joint may include a transition sleeve coupled to an expansion sleeve via a transition arm, the laterally rigid outer rim having a length and width, the laterally rigid outer rim being expandable and contractible in at least one of a lengthwise or widthwise dimension. The at least one attachment point for the netted sling is configured to allow the netted sling to cradle the bottom of the moldable mattress, the netted sling having a hammock configuration that adjusts with an expansion or contraction of the outer rim in the at least one of the lengthwise or widthwise dimensions.

According to various embodiments, the one or more mounting tracks may be configured to allow a set of control arms to releasably couple to the outer rim, the set of control arms coupling the outer rim to a gimballing plate and the control arms being adjustable with the expansion or contraction of the outer rim in the at least one of a lengthwise or widthwise dimension.

In some embodiments, the one or more mounting tracks may be configured to allow a transport gurney to couple to the outer rim. The transport gurney may include a set of castors operably coupled to a gurney base, and a gurney transfer support connected to the gurney base, wherein the gurney transfer support may be configured to attach to the one or more mounting tracks. The gurney transfer support may further be operable to attach to the laterally rigid outer rim while the laterally rigid outer rim is concurrently coupled to the set of control arms.

In some embodiments, the laterally rigid outer rim may be coupled to a gimballing base configured to gimbal about three axes.

In some embodiments the laterally rigid outer rim may have a substantially oval shape, or in some cases, a rectangular shape.

Another embodiment is a gimballing base for a moldable mattress. The gimballing base may include a movable base having a telescoping post, a gimballing plate, a gimbal connection between the gimballing plate and a distal end of the telescoping post configured to gimbal about three axes, and at least one control arm coupled to the gimballing plate. Each of the at least one control arms may be configured to couple with a supporting frame and restrict motion of the supporting frame in at least one degree of freedom relative to the gimballing plate.

According to various embodiments, the gimbal connection may be one of a 2-axis ball screw mechanism, a rack and pinion mechanism, a chain sprocket, or a direct drive motor coupled to a universal joint.

In some further embodiments, the gimballing base may include a control system programmed to tilt the central plate responsive to a user input, wherein the user input indicates at least a direction to tilt the central plate, and execute a turning routine, wherein the turning routine specifies one or more tilt positions for the tilt plate, wherein the routine further specifies at least a movement speed at which the tilt plate should be moved between the one or more tilt positions. Each of the at least one control arm may also be extendable.

In a further embodiment, a bed system is provided, the system including a moldable mattress and a supporting frame. The moldable mattress may include a casing having a bladder defining an inner volume and a top compliant surface over a top surface of the bladder, the compliant surface configured to conform to a shape of a displacing structure. A plurality of beads may be held within the inner volume. The casing may be configured so that the inner volume can be inflated and evacuated with a fluid medium, such that the casing is moldable when inflated, and maintains a resilient shape when an actuating volume of the fluid medium is evacuated. The plurality of beads may be distributed in the fluid medium within the inner volume. In use, with the inner volume of the casing inflated, a displacing structure disposed on the compliant surface may cause a displacement of at least a portion of the fluid medium and at least a portion of the plurality of beads in the inner volume of the casing and the casing may compress the plurality of beads to maintain a shape of the displacement by the displacing structure when an actuating volume of the fluid medium is evacuated. A supporting frame for the moldable mattress may include a laterally rigid outer rim having at least one attachment point for the moldable mattress, at least one attachment point for a netted sling, and one or more mounting tracks configured to support at least one peripheral attachment. The supporting frame may be expandable, having an expansion joint. The expansion joint may include a transition sleeve coupled to a right expansion sleeve via a transition arm, the laterally rigid outer rim having a length and width, the laterally rigid outer rim being expandable and contractible in at least one of a lengthwise or widthwise dimension. The moldable mattress may be coupled to the at least one attachment point, and the netted sling may be configured to cradle the bottom of the moldable mattress, the netted sling having a hammock configuration that adjusts with an expansion or contraction of the outer rim in the at least one of the lengthwise or widthwise dimensions.

According to various embodiments, the system may further include a gimballing base. The gimballing base may include a movable base having a telescoping post, a gimballing plate, and a gimbal connection between the gimballing plate and a distal end of the telescoping post. The gimbal connection may be configured to gimbal about three axes. At least one control arm may be operably coupled to the gimballing plate and releasably attached to the outer rim, wherein the control arms are configured to restrict motion of the supporting frame in at least one degree of freedom relative to the gimballing plate.

Another embodiment is a moldable mattress including a casing comprising a bladder defining an inner volume, the bladder having an impermeable top bladder surface, and a permeable top compliant surface over the impermeable top bladder surface. The permeable top compliant surface is configured to conform to a shape of a displacing structure. The permeable top compliant surface is configured to define a fluid flow space between the top bladder surface and the displacing structure. One or more evacuation tubes are configured to drain fluid from the top bladder surface, the one or more evacuation tubes being in fluid communication with a pump system via one or more fluid pump lines.

Embodiments may include a plurality of beads within the inner volume. In such embodiments the casing is configured so that the inner volume can be inflated and evacuated with a fluid medium, such that the casing is moldable when inflated, and maintains a resilient shape when an actuating volume of the fluid medium is evacuated. The plurality of beads are distributed in the fluid medium within the inner volume. In use, with the inner volume of the casing inflated, a displacing structure disposed on the compliant surface causes a displacement of at least a portion of the fluid medium and at least a portion of the plurality of beads in the inner volume of the casing. The casing compresses the plurality of beads to maintain a shape of the displacement by the displacing structure when an actuating volume of the fluid medium is evacuated.

Embodiments may include the one or more evacuation tubes having at least some evacuation tubes in fluid communication with the pump system configured to evacuate waste fluids and at least some evacuation tubes being ventilation tubes in fluid communication with the pump system configured to provide ventilation to the top surface of the bladder.

Embodiments may include an evacuation header having one or more fluid pump line interfaces configured to couple to the one or more fluid pump lines, the evacuation header having an inner chamber for holding liquid drained from the top surface of the bladder via the one or more evacuation tubes.

Another embodiment is a bed system comprising two or more of:

(1) A mattress, the mattress having a casing made in part of a bladder defining an inner volume, the bladder having an impermeable top bladder surface and a permeable top compliant surface over the impermeable top bladder surface. The permeable top compliant surface conforms to a shape of a displacing structure. The permeable top compliant surface is configured to define a fluid flow space between the top bladder surface and the displacing structure. The mattress further includes one or more evacuation tubes configured to drain fluid from the top bladder surface, the one or more evacuation tubes being in fluid communication with a pump system via one or more fluid pump lines.

(2) A supporting frame for a moldable mattress the supporting frame having a laterally rigid outer rim having at least one attachment point for the mattress, at least one attachment point for a netted sling, and one or more mounting tracks configured to support at least one peripheral attachment. The supporting frame further includes an expansion joint including a transition sleeve coupled to an expansion sleeve via a transition arm. The laterally rigid outer rim has a length and width, and by virtue of the expansion joint is expandable and contractible in at least one of a lengthwise or widthwise dimension. The mattress is coupled to the at least one attachment point, and the netted sling is configured to cradle the bottom of the mattress. The netted sling has a hammock configuration that adjusts with an expansion or contraction of the outer rim in the at least one of the lengthwise or widthwise dimensions.

(3) A gimballing base having a movable base with a telescoping post, a a gimballing plate and a gimbal connection between the gimballing plate and a distal end of the telescoping post configured to gimbal about three axes. At least one control arm is operably coupled to the gimballing plate and releasably attached to the laterally rigid outer rim, wherein the control arms are configured to restrict motion of the supporting frame in at least one degree of freedom relative to the gimballing plate.

Various modifications and additions can be made to the different embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

While various aspects and features of certain embodiments have been summarized above, the following detailed description illustrates a few embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
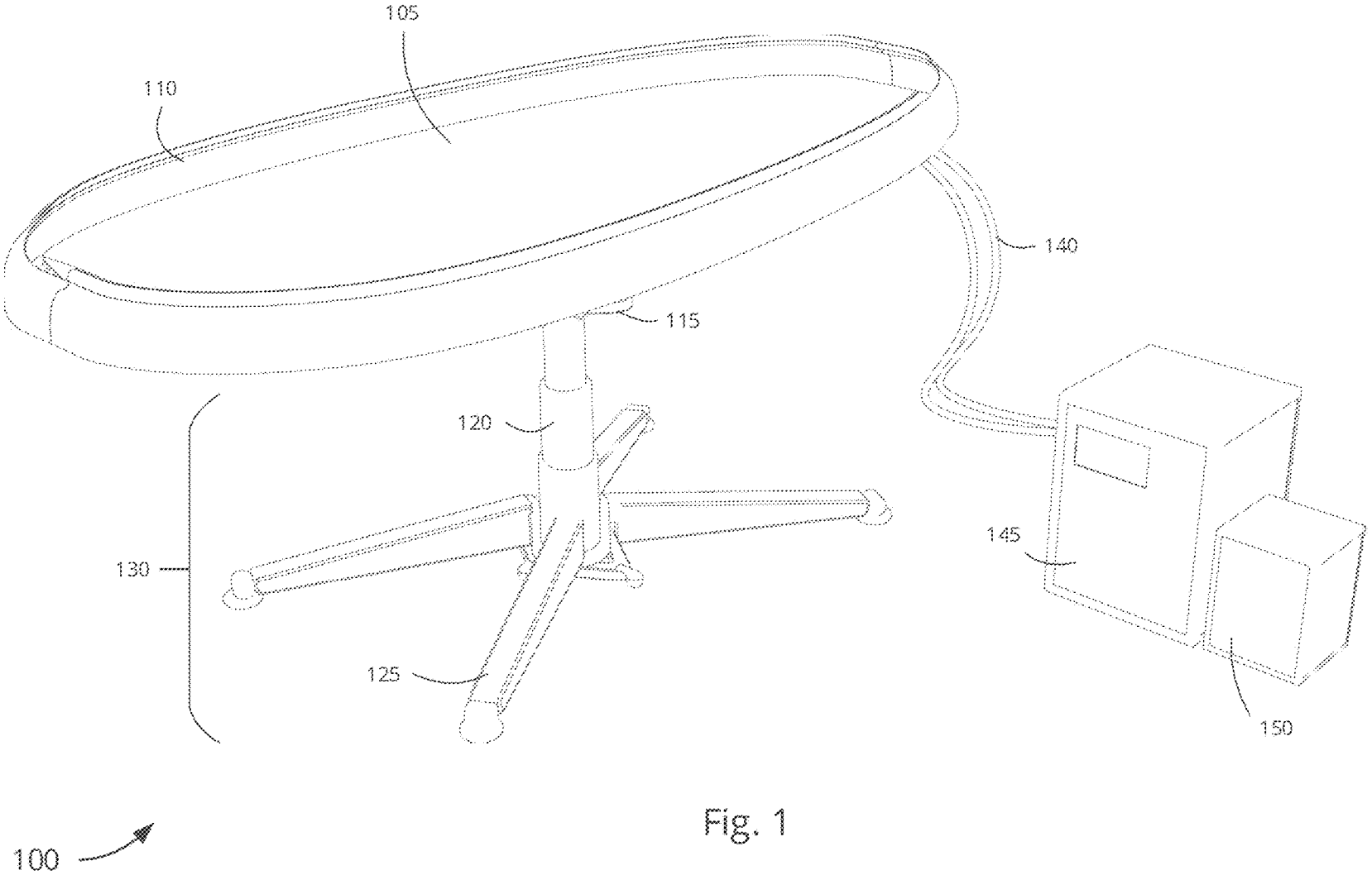
FIG. 1 is a perspective view of a bed system, in accordance with various embodiments.

FIG. 1 illustrates a bed system 100, in accordance with various embodiments. The system 100 includes a moldable mattress 105, supporting frame 110, a base 130 having a gimballing plate 115, telescoping post 120, and base legs 125, fluid pump lines 140, sanitizing trap 145, and fluid pump system 150. According to various embodiments, the moldable mattress 105 may be coupled to supporting frame 110. The supporting frame 110 may, in turn, be operably coupled to the gimballing plate 115 of the gimballing base 130. The moldable mattress 105 may further be coupled to the fluid pump system 150 and sanitizing trap 145 via fluid pump lines 140. Each of the fluid pump system 150 and gimballing base 130 may further be in communication with a control system, as described in more detail with respect to FIGS. 15 & 16.

Figure 5A:
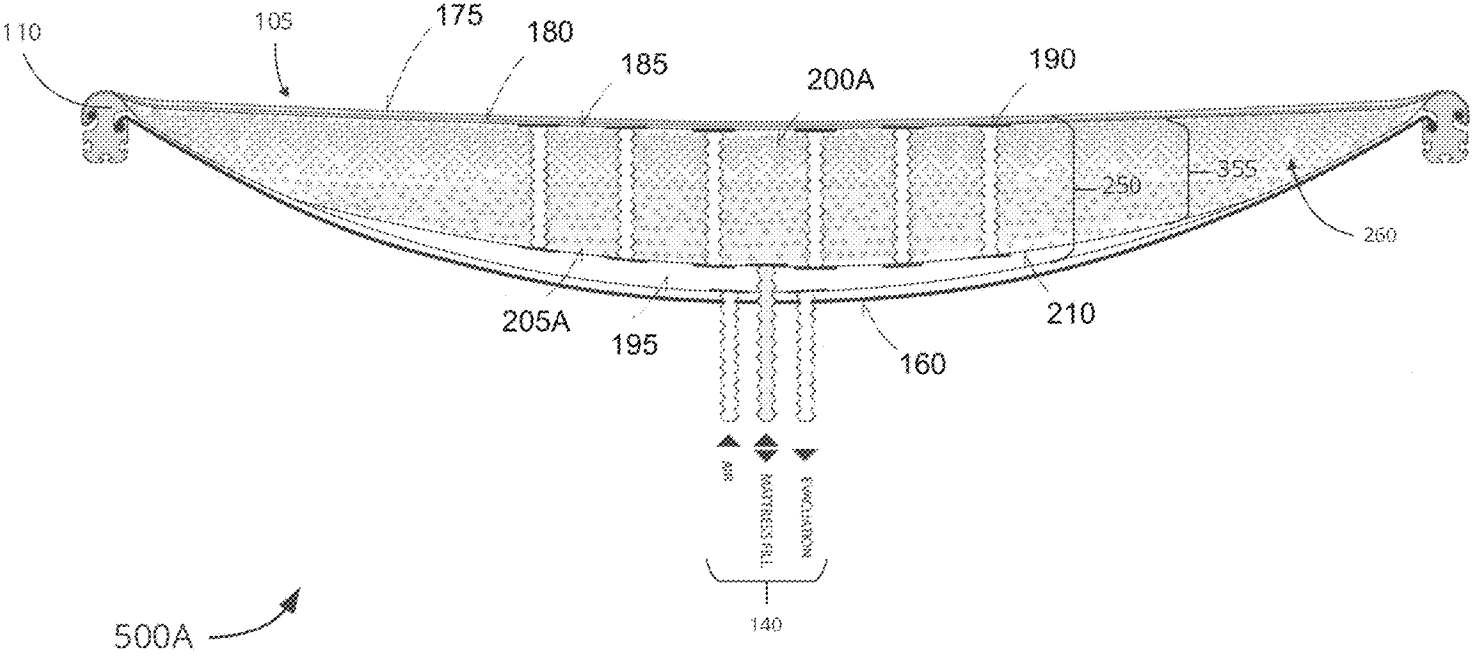
FIG. 5A is a cross-sectional view of the moldable mattress of the bed system of FIG. 1, in accordance with various embodiments.
Figure 5B:
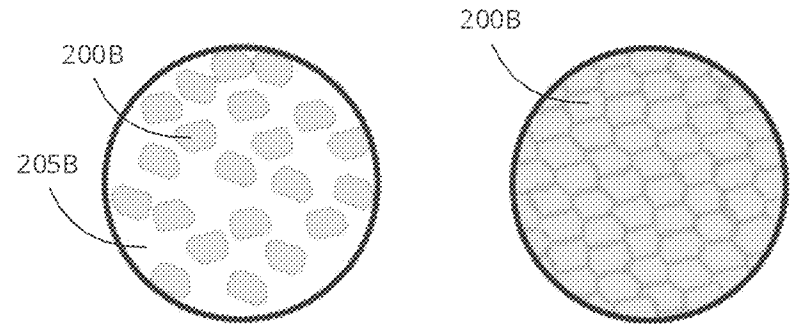
FIG. 5B is a partially enlarged view of the inside of a moldable mattress of FIG. 5A, in accordance with various embodiments.

With reference to additional features illustrated in FIGS. 5A & 5B, according to various embodiments, the moldable mattress 105 may include a casing 250 having a bladder 355 defining an inner volume 260 holding a plurality of beads 200A, 200B (collectively 200), and filled with a fluid medium 205A, 205B (collectively 205). In some embodiments, the moldable mattress 105 may be filled with a non-compressible fluid, such as, without limitation, siloxane, water, organic liquids, oil-based hydraulic fluids, glycols, esters, polymers, or other suitable hydraulic fluids. In other embodiments, the moldable mattress 105 may be filled with a compressible fluid, such as air, carbon dioxide, nitrogen, inert gases, and gas mixtures other than air or other suitable pneumatic fluid. In some embodiments, the plurality of beads may include closed-cell polymer beads, such as, without limitation, expanded polypropylene, expanded polyethylene, expanded polystyrene, expanded polyurethane, expanded neoprene, polyamide, polyvinyl chloride, polyacrylonitrile, or other suitable polymeric materials. In some embodiments, the plurality of beads may include a solid bead created from a soft, deformable, polymer material. In alternative embodiments, open-cell geometries may be utilized for the expanded polymer beads. In yet further embodiments, the plurality of beads 200 may include all or any sub-combination of closed-cell, open-cell, and solid bead geometries.

In some embodiments, the plurality of beads 200 may have a lower specific gravity than the fluid medium 205, allowing the plurality of beads 200 to float in the fluid medium. For example, in one embodiment, beads 200 may be utilized having a specific gravity of approximately 0.85, relative to the fluid medium 205. Thus, in one set of embodiments, the plurality of beads 200 may promote flotation of individuals or objects resting on the moldable mattress 105.

In various embodiments, the number and density of beads 200 within the inner volume 260 may be tuned to allow the beads 200 to behave in a fluid manner, freely moving within the casing 250 of the moldable mattress 105 when in the presence of the fluid medium 205. In some embodiments, to facilitate this behavior, a fluid medium 205 with lubricating properties may be utilized to lubricate the beads, or, alternatively or in addition, beads 200 having low surface friction may be utilized. Thus, in various embodiments, the beads 200 will redistribute pressure evenly around a displacing individual or object resting on the moldable mattress 105.

The moldable mattress 105 may include a compliant surface 175 that allows the moldable mattress 105 to conform to the shape of an individual or other object placed on the moldable mattress 105. Thus, when an individual or an object rests on the moldable mattress 105, the beads 200 may displace around the individual or object, and the compliant surface 175 may further help the moldable mattress 105 mold to the shape of the individual or object. In one set of embodiments, the compliant surface 175 may be a spandex layer.

FIG. 5B is a partially enlarged view 500B, more clearly illustrating these features. The left panel of the enlarged view 500B shows the plurality of beads 200B suspended in a fluid medium 205B inside of the bladder 355. In a suspended state, the plurality of beads 200B have fluid medium 205B present between individual beads of the plurality of beads 200B, allowing the plurality of beads 200B to move freely around each other and in the fluid medium 205B When compressed, as depicted in the right panel, the plurality of beads 200B compress against each other under the weight of the patient or displacing object, with the fluid medium 205B having been evacuated. In various embodiments, the plurality of beads 200B may have an aspherical shape, allowing the beads to interlock with each other. In various embodiments, each individual bead 200B may have a closed-cell structure. In a closed-cell structure, multiple, discrete pockets of air or other gas may be present within each bead. Each pocket of air or gas may be separate from the other pockets, and contained within in an outer surface of the bead. In various other embodiments, a solid bead may be utilized. In yet further embodiments, an open cell structure may be utilized, where the pockets of air may be joined, forming interconnected cavities within each bead.

Figure 4:
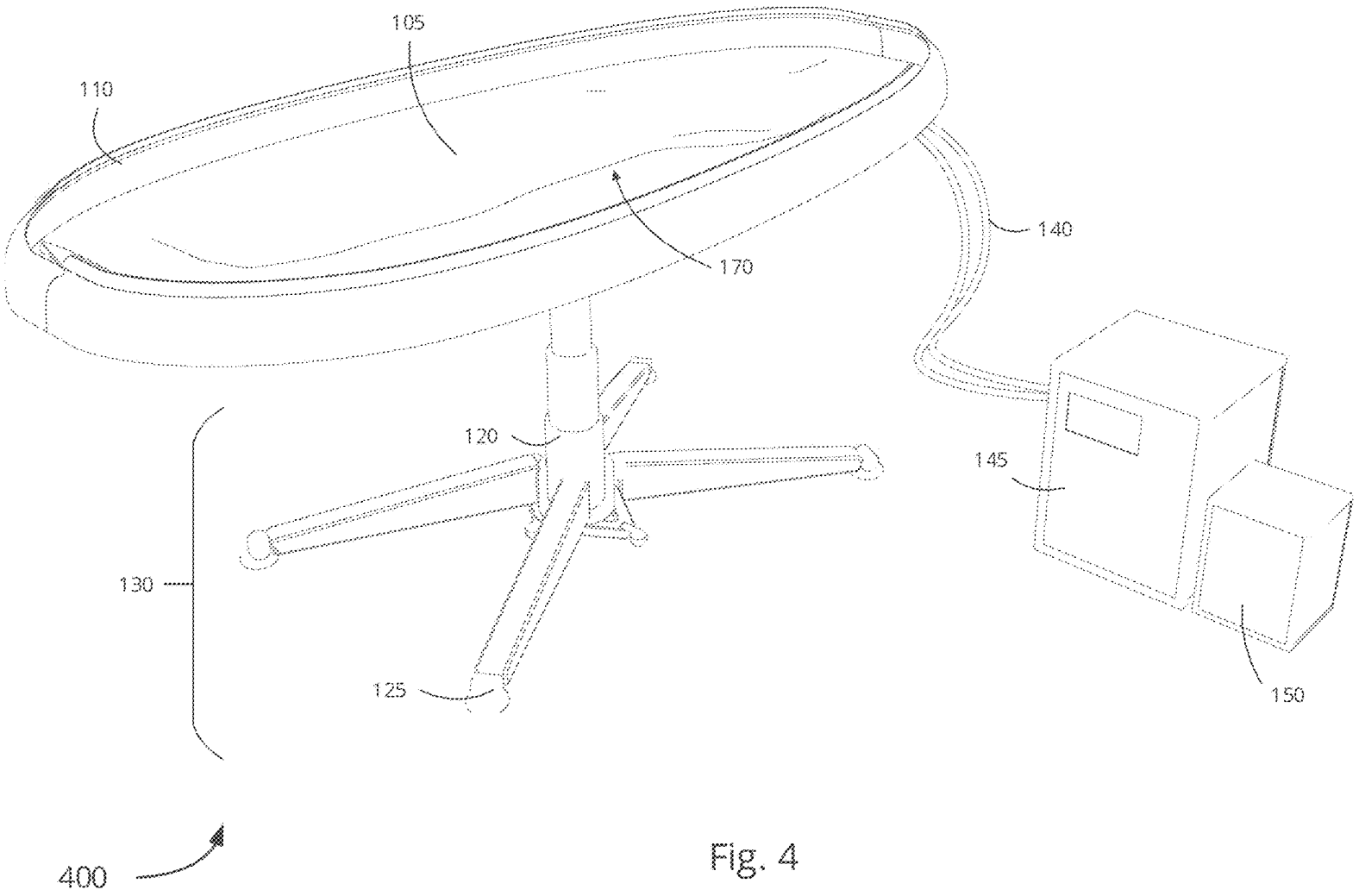
FIG. 4 is a perspective view of the bed system of FIG. 1 with a moldable mattress in a molded configuration, in accordance with various embodiments.

In various embodiments, to retain the shape of the displacement caused by the individual or object, the fluid medium 205 may be evacuated from the inner volume 260 of the moldable mattress 105. The evacuation of the fluid medium 205 and weight of the individual or object may cause the plurality of beads 200 to compress together. When compressed, the plurality of beads 200 may interlock with one another, forming a resilient, gel-like structure, molded to and supporting the individual or object, as shown in FIG. 5B. In various embodiments, each individual bead of the plurality of beads 200 may deform under compression by the individuals when the fluid medium 205 is evacuated, and reform when the individual or object is removed or when the moldable mattress 105 is filled with the fluid medium 205. The impression made by a displacing individual or object is illustrated in FIG. 4, which provides a perspective view 400 of the bed system 100 in a molded configuration, in accordance with various embodiments. Here, the moldable mattress 105 includes a depression 170 made by a patient, and maintained by the evacuation of fluid medium 205 from the moldable mattress 105.

According to various embodiments, the bladder 355 of the moldable mattress 105 may be a pliant, impermeable material. In some embodiments, for example, the bladder 355 may be polyurethane, polyvinyl chloride, polyethylene, polypropylene, or other similarly pliable and waterproof polymeric material for non-compressible fluid media. In other embodiments, the bladder 355 may, in addition to the materials utilized for non-compressible fluid media, include nylon polyester or other woven textile materials suitable for compressible fluid media. In various embodiments, an inner volume 260 of the bladder 355 may be filled with a fluid medium 205, as well as evacuated of the fluid medium 205 via fluid pump lines 140. In the illustrated embodiments, the casing 250 comprises the bladder 355 defining the inner volume 260. Other embodiments of the casing 250 may itself define the inner volume 260 and the casing 250 does not include a separate bladder 355. In some embodiments, one or more fluid pump lines 140 may be dedicated to filling and evacuating the bladder 355. For example, in some embodiments, a single dedicated fluid pump line 140 may be utilized to both fill and evacuate the bladder 355. In other embodiments, separate fluid pump lines 140 may be used—one to fill and one to evacuate the bladder 355.

According to some embodiments, the pump system 150 may include one or more pumps. In various embodiments, the one or more pumps 150 may include, without limitation, one or more of a positive displacement pump, hydraulic pump, vacuum pump, or other suitable types of fluid pump. In other embodiments, the pump 150 may be a compressible reservoir. In some embodiments, separate fluid pumps 150 may be utilized for inflation and evacuation, while in other embodiments, a single two-way pump 150 may be able to provide both inflation and evacuation capabilities. In some embodiments, the pump system 150 may further be configured to remove waste, water, and moisture from an evacuation header of casing 250 of the moldable mattress 105, as will be described in further detail below. In some further embodiments, the temperature of the fluid medium may be adjusted by means of a heater or cooler controlled by a thermostat operatively associated with the fluid pump system 150. Accordingly, the fluid pump system 150 may be operable to heat or cool the fluid medium 205 as desired by an individual using the moldable bed system 100.

In further embodiments, the top compliant surface 175 may further be configured to protect the skin of an individual resting against the moldable mattress 105. For example, the top compliant surface 175 may protect the skin against shearing and frictional forces that would otherwise occur with direct contact between the patient's skin and a top bladder surface 185 of the moldable mattress 105. The top compliant surface 175 may be a textile layer, made from fabric, plastic, or other materials. The top compliant surface 175 may further be disposable and replaceable for hygienic purposes. In some embodiments, the top compliant surface 175 may have a shore A durometer rating of less than 10. In other embodiments, the top compliant surface 175 may have an elongation factor of at least 300 percent.

In further embodiments, the moldable mattress 105 may include an intermediate layer 180 between the top compliant surface 175 and the top bladder surface 185 configured to define a fluid flow space between the top bladder surface 185 and the top compliant surface 175 to increase air permeability and liquid permeability between the individual or object and the top bladder surface 185 of the moldable mattress 105. In some embodiments, the intermediate layer 180 may be a spandex layer. In various embodiments, the intermediate layer 180, may create further separation between the skin of the patient and the top bladder surface 185 of the moldable mattress 105, as well as diffusing any moisture underneath the individual over a larger surface area. In further embodiments, the intermediate layer 180 may also aid in the reduction of shearing and frictional forces on the skin of the individual, and between the top compliant surface 175 and top bladder surface 185 of the moldable mattress 105. An intermediate layer 180 of spandex may provide some or all of these features.

According to various embodiments, liquid waste and water may pass through top compliant surface 175 and intermediate layer 180 to the top bladder surface 185. For example, FIG. 5A illustrates a cross-section 500A of a moldable mattress 105, illustrating these features. In various embodiments, the cross-section 500 of moldable mattress 105 includes supporting frame 110, a top compliant surface 175, intermediate layer 180, a top bladder surface 185, evacuation tubes 190, fluid pump lines 140, netted sling 160, evacuation header 195, fluid medium 205A, a plurality of beads 200A, and a bladder bottom 210.

According to various embodiments, the moldable mattress 105 may include a casing 250 with a bladder 355 defining a first inner volume 260. The bladder 355 may be filled with a fluid medium 205 and have a plurality of beads 200A suspended within the fluid medium. A second inner volume may be defined by an evacuation header 195. The evacuation header 195 may be connected to a top bladder surface 185 of the bladder 355 via a plurality of evacuation tubes 190, the evacuation tubes 190 draining liquid waste and water into the evacuation header 195 for evacuation. In various embodiments, the evacuation header 195 may also provide fluid pump line interfaces for the fluid pump lines 140.

According to various embodiments, the plurality of evacuation tubes 190 may be positioned strategically to maximize draining efficiency and ventilation of moisture, draining the liquid waste and water without pooling underneath the patient. For example, evacuation tubes 190 may be provided around the head, neck, armpits, elbows, knees, lower back, or other areas anticipated to produce moisture or waste products. In further embodiments, evacuation tubes 190 may be placed to coincide with areas anticipated to be compressed when a patient is placed into common positions, and thus more likely to pool liquid and moisture. Alternatively, evacuation tubes 190 may be placed evenly throughout the moldable mattress 105 to provide even ventilation and drainage properties across the entire top bladder surface 185. In various embodiments, the evacuation tubes 190 may be constructed from the same material as the casing, but configured to have a non-collapsible, or a collapse resistant design. In further embodiments, the evacuation tubes 190 may further include reinforcing structures for resistance to collapsing.

In various embodiments, the evacuation tubes 190 may also prevent moisture buildup underneath the individual by drawing ventilation and air flow around the patient. In some embodiments, a set of ventilation tubes, separate from the evacuation tubes 190 may be provided for air circulation and ventilation. Accordingly, the pump system 150 may further include a blower, fan, or vacuum to further circulate air around the patient or individual.

The fluid pump lines 140 may couple bladder, and the evacuation header 195 to a pumping system 150 and sanitizing trap 145. In some embodiments, a mattress fill fluid pump line 140 may be in fluid communication with the bladder 355 via a fluid pump line interface located in the bladder bottom 210. In some embodiments, a single mattress fill fluid pump line 140 may be sufficient for both filling and evacuating functions. In other embodiments, one or more mattress fill fluid pump lines 140 and fluid pump line interfaces may be utilized. In yet further embodiments, one or more mattress fill fluid pump lines 140 may be used exclusively to fill the mattress while one or more mattress evacuation fluid pump lines 140 may be used to exclusively evacuate the fluid medium. In further embodiments, heated or cooled fluid medium 205A may be pumped into the bladder 355. In some embodiments, to maintain a desired temperature of the fluid medium, the fluid medium may be cycled continuously through two or more fluid pump lines 140.

According to various embodiments, the evacuation and air fluid pump lines 140 may be in fluid communication with the evacuation header 195. In certain embodiments, the evacuation fluid pump line 140 may be utilized to exclusively evacuate waste fluids and water from the evacuation header 195. The fluid pump lines 140 may include an air pump line and may be utilized to pump air into the evacuation header 195, providing ventilated air through the evacuation tubes 190, as well as creating separation in the evacuation header 195 from the bladder bottom 210. In some embodiments, as with the mattress fill fluid pump line 140, a single evacuation fluid pump line 140 may be used to both evacuate and ventilate the evacuation header 195. According to further embodiments, the evacuation header 195 may have separate volumes associated with each of the evacuation and air fluid pump lines 140 respectively. For example, a first volume of the evacuation header 195 may be coupled to the evacuation fluid pump line 140, and may further be associated with a first set of evacuation tubes 190 to drain and evacuate waste. A second volume of the evacuation header 195 may define a ventilation chamber that may be coupled to the air fluid pump line 140, and may further be associated with a second set of dedicated ventilation tubes 190.

Figure 8:
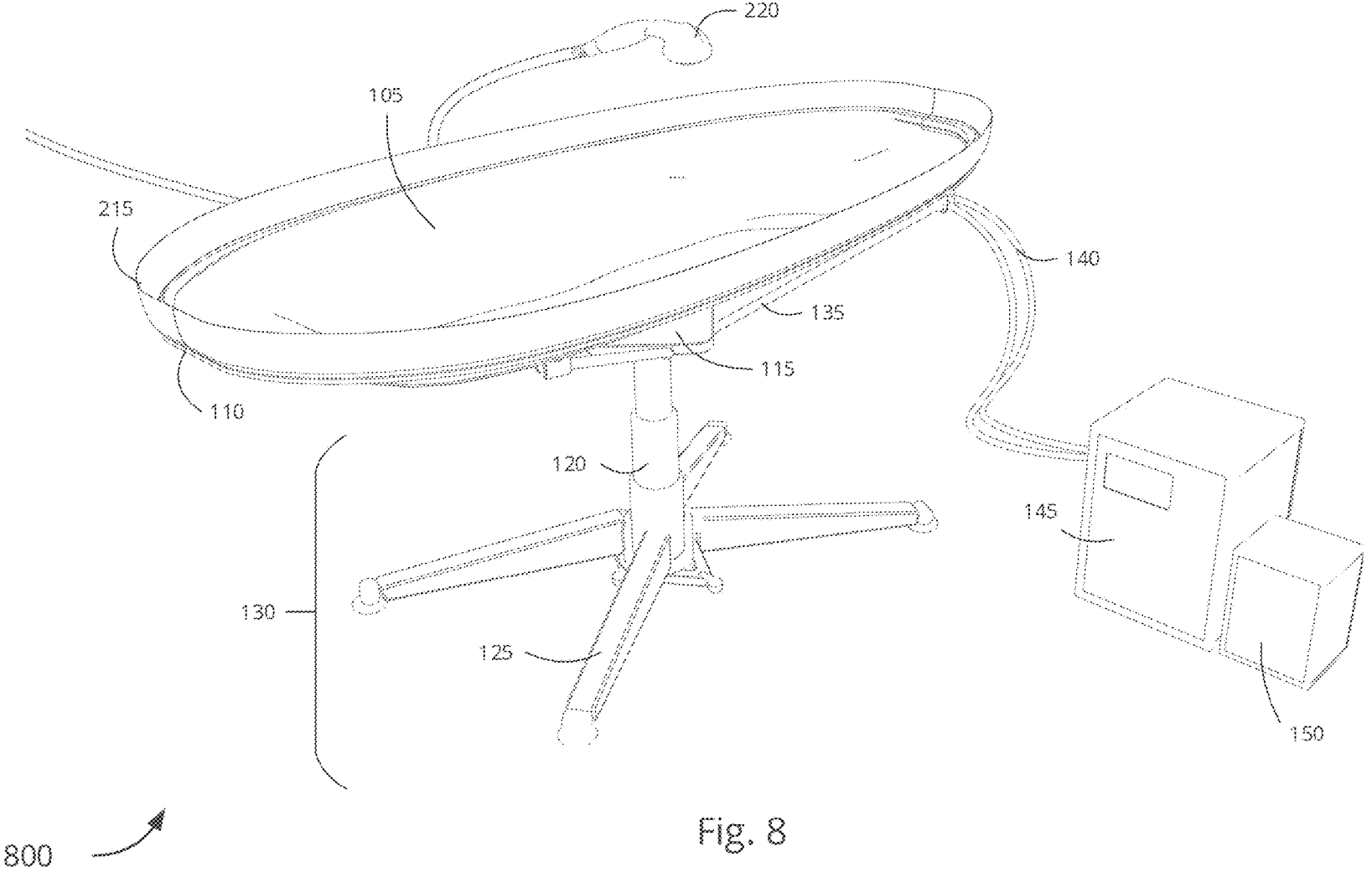
FIG. 8 is a perspective view of the bed system of FIG. 1 in a bathing configuration, in accordance with various embodiments.

In further embodiments, with reference to FIG. 8, the casing 250 of the moldable mattress 105 may further include an outer skirt 215 that may be raised or lowered as a splash guard during bathing of the individual on the moldable mattress 105. FIG. 8 illustrates a perspective view of the bed system 100 in a bathing configuration 800, in accordance with various embodiments. The bed system 100 may include a moldable mattress 105, supporting frame 110, a base 130 with a gimballing plate 115, telescoping post 120, base legs 125, and control arms 135, fluid pump lines 140, a pump system 150, sanitizing trap 145, a splash guard skirt 215, and shower head 220.

In some embodiments of the bathing configuration, the casing of the moldable mattress 805 may include casing material forming a flange or skirt 215 around the perimeter of the casing 250. The skirt 215 may be raised up when in use, and lowered when not in use. In some embodiments, when in the raised position, the skirt 215 forms a splash guard around the perimeter of the moldable mattress 105, preventing excess water or cleaning solution from spilling over the sides of the moldable mattress 105.

In some embodiments, the skirt 215 may channel the bath water or cleansing solution, and direct it back towards the moldable mattress 105, to an evacuation tube 190 of the moldable mattress 105, or to another suitable draining point. Thus, a patient on the bed system 100 may additionally be cleaned and bathed by a caregiver while remaining on the moldable mattress 105. In various embodiments, the patient may be tilted in various directions to help reposition the patient during the bathing process, via the gimballing plate 115. In some embodiments, the pump system 150 may continuously pump away the bathwater or bathing solution for the duration of the bath, or in other embodiments, may be manually activated by the caregiver as needed to remove excess bath water.

According to various embodiments, in order to disinfect and deodorize the liquid waste and water, pump system 150 may pump waste fluid through a sanitizing trap 145. In various embodiments, the sanitizing trap 145 may disinfect and deodorize the recovered liquid waste, water, and any circulating air. In various embodiments, the sanitizing trap 145 may employ any or all of a bubble trap, filter, sanitizing solution, disinfecting UV lamp, among other deodorizing technologies. The sanitizing solution may include, without limitation, any of an iodine-based, copper sulfate, or potassium iodide solution. In some embodiments, the sanitizing solution may also be used to bathe the patient, and as such, may further be one or more of odorless, non-staining, non-bleaching, and non-irritating to the skin.

Figure 3:
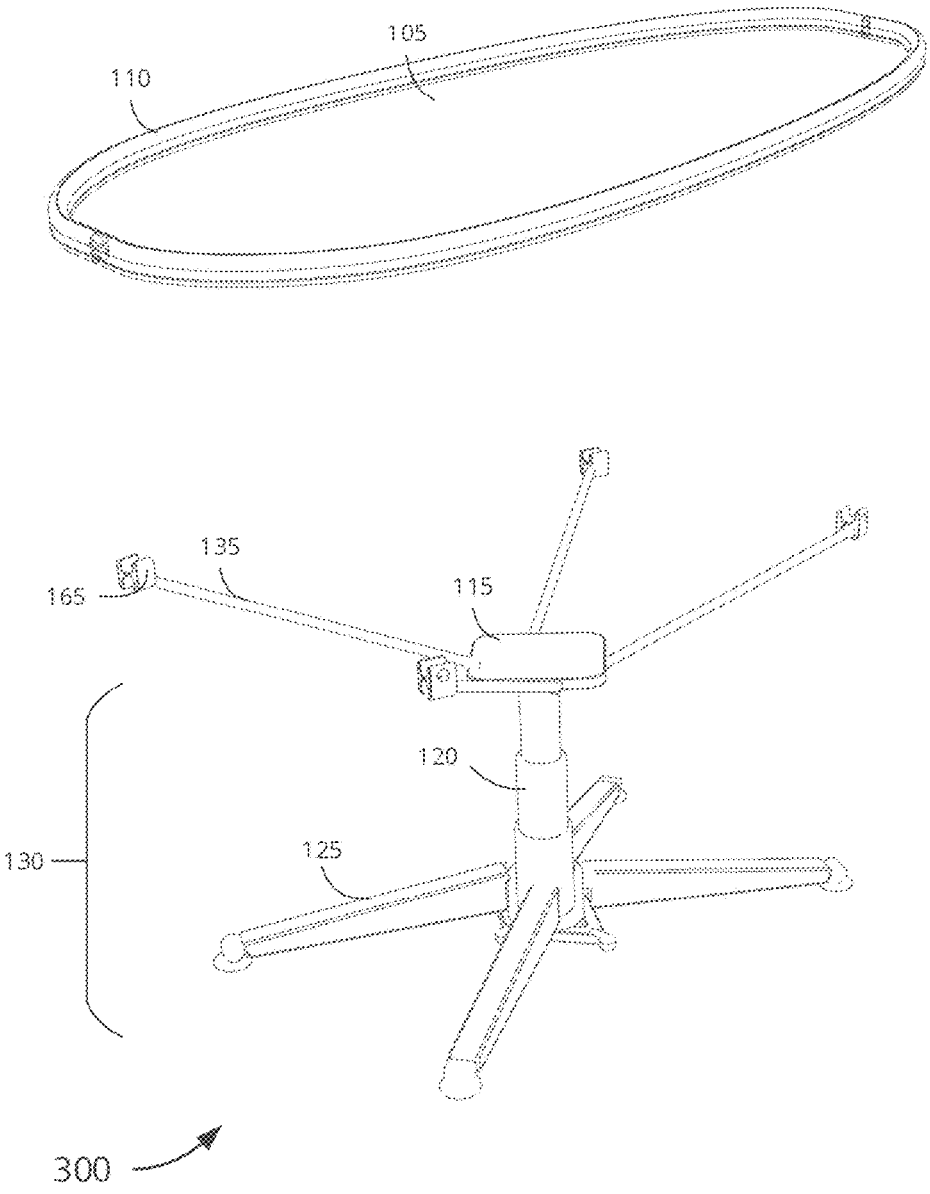
FIG. 3 is a partially exploded view of the bed system of FIG. 1, in accordance with various embodiments.

FIG. 3 is a partially exploded view 300 of a bed system 100, in accordance with various embodiments. Here, the moldable mattress 105 is depicted attached to the supporting frame 110. The netted sling 160 supports the moldable mattress from underneath, cradling the moldable mattress 105 to create a hammock effect. As shown, the moldable mattress 105 maintains a substantially flat top surface 175, 185. The supporting frame 110 and moldable mattress 105 may then couple to the gimballing base 130 via the control arms 135. The control arms 135 may attach to the supporting frame 110 via the control arm connectors 165 with both the moldable mattress 105 and netted sling 160 already attached to the supporting frame 110. With the control arms 135 locked, restricting movement relative to the gimballing plate 115, the assembled moldable mattress 105 and supporting frame 110 may be gimballed in three axes, allowing assembled moldable mattress 105 and supporting frame 110 to tilt, tip, and rotate in any direction. The telescoping post 120 may allow the moldable mattress 105 and supporting frame 110 to be raised and lowered while maintaining its position relative to the gimballing plate. Base legs 125 may be utilized to stabilize the gimballing base 130 during operation and repositioning of the moldable mattress 105 and supporting frame 110.

Figure 12:
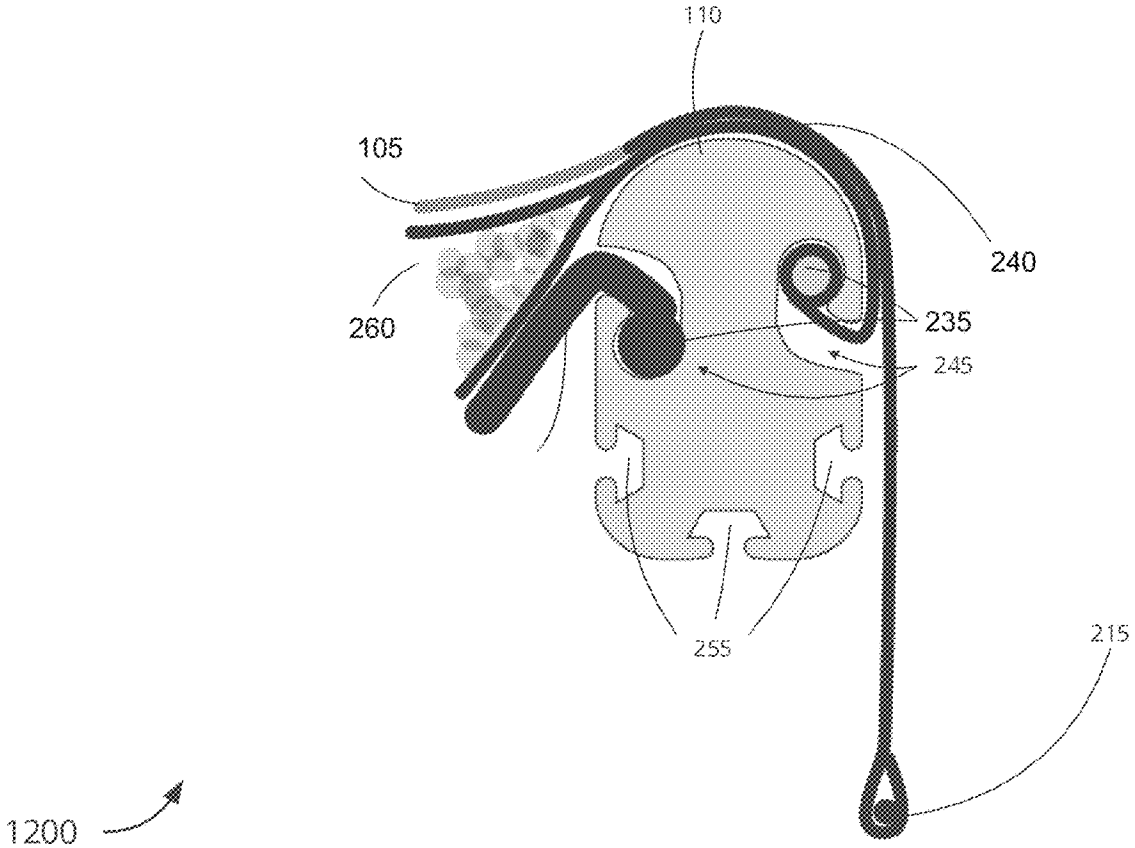
FIG. 12 is a transverse cross-sectional view of a supporting frame with a moldable mattress attached of FIG. 1, in accordance with various embodiments.
Figure 13:
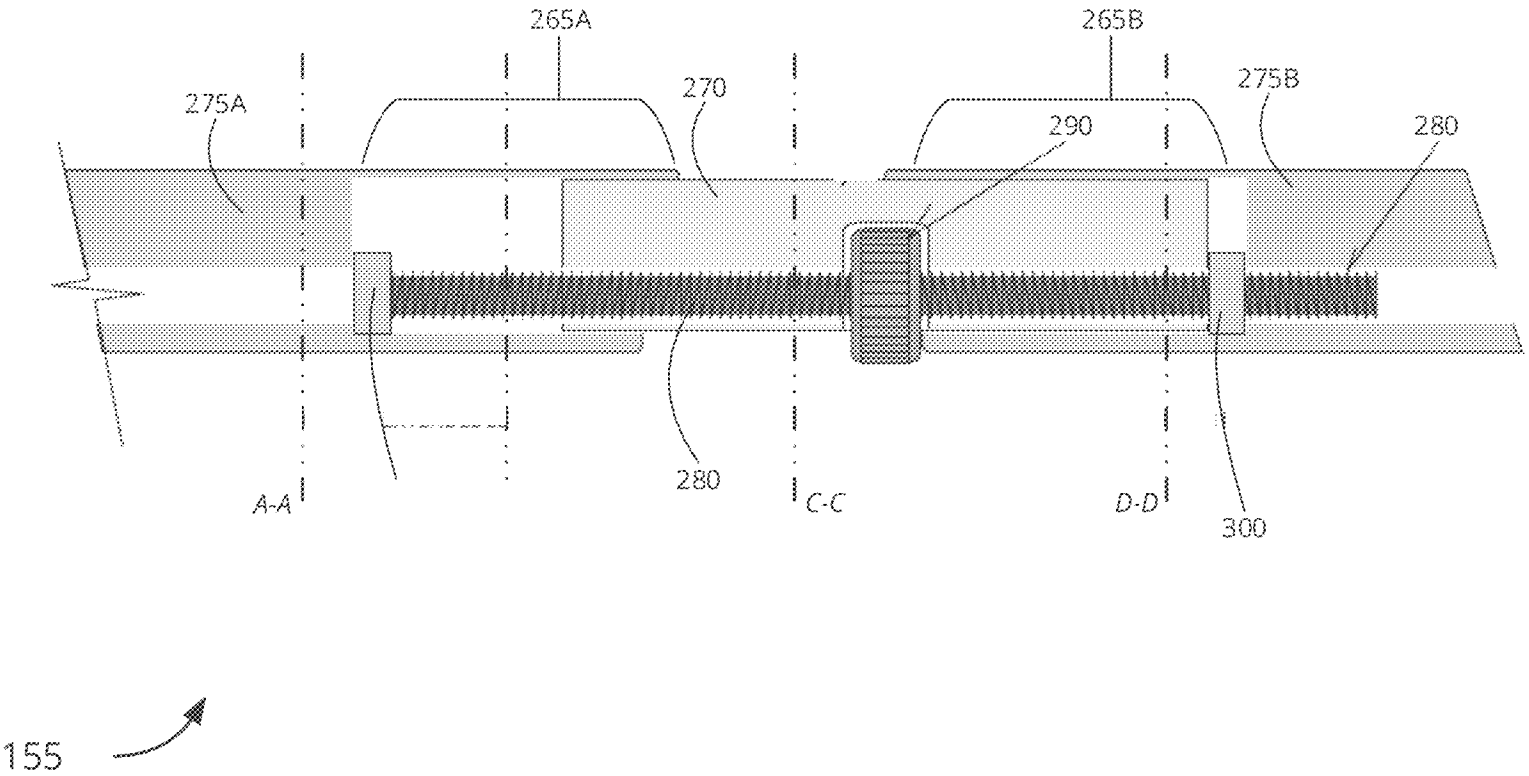
FIG. 13 is a longitudinal cross-sectional view of a supporting frame expansion joint for use with the bed system of FIG. 1, in accordance with various embodiments.
Figure 14A:
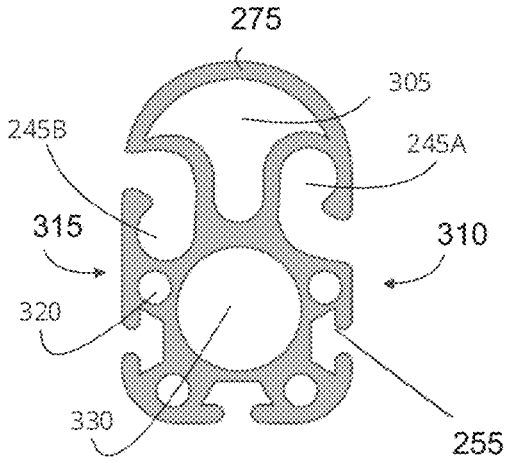
FIG. 14A is a transverse cross-sectional view of an attachment rail of a supporting frame for use with the bed system of FIG. 1, in accordance with various embodiments.

Referring to FIGS. 12, 13 & 14A, in various embodiments, moldable mattress 105 may be coupled to supporting frame 110. FIG. 12 illustrates a cross-section 1200 of a supporting frame 110, in accordance with various embodiments. In the cross-section 1200 of the supporting frame 110, a moldable mattress 105 is coupled to the supporting frame 110 via a fastening bungee 235.

Figure 2:
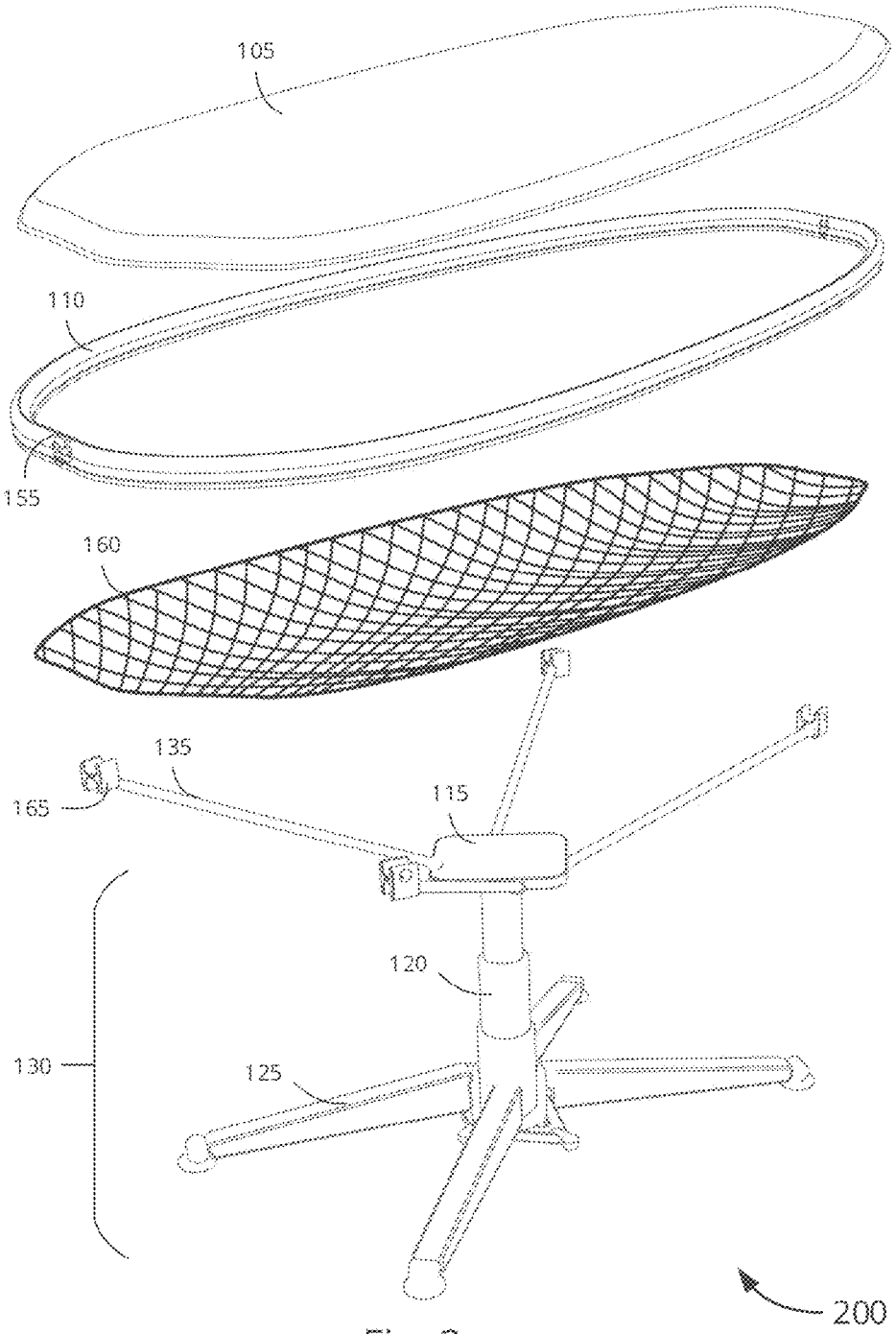
FIG. 2 is an exploded view of the bed system of FIG. 1, in accordance with various embodiments.

The supporting frame 110 may include a laterally rigid outer rim 275A, 275B (collectively 275) having one or more attachment points 245. The one or more attachment points 245 may allow various structures to attach to the outer rim 275, including, without limitation, the moldable mattress 105 and sling 160, which may be a netted sling as illustrated in FIG. 2. In various embodiments, the casing 250 may include a gusseted sleeve with a fastening bungee 235 encompassing a perimeter of the gusseted sleeve. The gusseted sleeve fastening bungee 235 may be configured to wrap around the support frame 110 having respective outside facing attachment points 245, and in which the bungee may be seated to fasten around the support frame 110. In other embodiments, the attachment point may be placed in different parts of the supporting frame 110, for example, along the interior, or on the top or bottom edge. In one set of embodiments, as illustrated in FIG. 12, the fastening bungee 235 may be attached to an outside facing mattress attachment point 245A of the supporting frame 110.

In some further embodiments, to further support the moldable mattress 105, the netted sling 160 may cradle the moldable mattress 105 from underneath. The netted sling 160 may create a hammock effect, supporting the weight of the moldable mattress 105 as it hangs from the supporting frame 110, as well as giving the moldable mattress 105 shape and depth. The netted sling 160 may similarly include a bungee-type fastener 235, through which the net sling 160 may be coupled to an inside facing attachment point 245B of the supporting frame 110. However, it is to be understood that in other embodiments, other secure attachment structures could be used securely attach the netted sling 160 to the supporting frame 110 and is in no way limited to the fastening bungees 235 and respective attachment points 245 as described above. In various embodiments, the size, material, and weaving design of the netted sling 160 may be adjusted to provide a desired amount of slack or support, expansion characteristics of the netting, or load-bearing strength. In some embodiments, the fastening bungee 235 of the netted sling 160 may seat into a separate, respective attachment point 245 for the netted sling 160. In other embodiments, the same attachment points 245 may be used for both the moldable mattress 205 and netted sling 245. As with the attachment point for the moldable mattress 105, the attachment point for the netted sling 245 may also be placed along any of the exterior or interior of the frame 210, or on the top or bottom edge of the supporting frame 210. The casing 250 of the moldable mattress 105 may further include a mattress splash guard skirt 215 that may rest over the side of the rail 110. In one set of embodiments, the splash guard skirt 215 may be formed from casing material present around the perimeter of the casing 250. The skirt 215 may be raised up when in use, and lowered when not in use. As depicted, the supporting frame 110 may be slightly raised along a top edge, with the moldable mattress 105 sitting slightly below the top edge. Accordingly, the mattress flange 240, from which the splash guard skirt 215 extends, may rest in a raised position, further aiding in the positioning of patients on the moldable mattress 105, as well as preventing the fluid medium 205 and plurality of beads 200 of the inner volume 260 from extending over the sides of the supporting frame 110. As seen in FIG. 12, the splash guard may define a channel at its distal end and a bungee may be received in the channel to bias the splash guard to either its rest position shown in FIG. 12 or a raised position as seen in FIG. 8.

According to various embodiments, the supporting frame 110 may further include one or more attachment mounting tracks 255. In various embodiments, the attachment mounting tracks 255 may be configured to support one or more peripheral attachments, such as, without limitation, an intravenous (IV) pole for IV drip bags and lines, bed rails, bedpans and urinals, overbed tables, trapeze bars, lamps, monitors, urine drainage bags, fecal collectors, or any other hospital bed or bedside accessories. In various embodiments, the attachment mounting tracks 255 may also be configured to couple to one or more control arm connectors 165, or a gurney transfer support 230.

Thus, the supporting frame 110 must generally be strong enough to support the weight of a filled moldable mattress 105, the patient, as well as any mounted peripheral attachments. Accordingly, in some embodiments, the supporting frame 110 may be a lightweight, high strength alloy material, such as, without limitation, extruded aircraft aluminum, or other suitable material as will be apparent to those skilled in the art. The supporting frame could also be extruded from advanced polymers or magnesium alloys to provide a radiolucent, MRI compatible frame so that patients can be imaged from the bed without needing to be removed.

According to various embodiments, the moldable mattress 105 and supporting frame 110 may have a substantially elliptical shape. However, in various other embodiments, the moldable mattress and supporting frame 110 may take on different shapes, including, but not limited to, a circular, hemispheric egg, rectangular, polygonal, or irregular shape. In some further embodiments, the moldable mattress 105 may be pliable enough to conform to the shape of the supporting frame.

According to various embodiments, when the moldable mattress 105 is seated within the supporting frame 110, and supported by the netted sling 160, in a first state, the moldable mattress 105 is substantially flat and non-rigid (i.e., flexible or floppy), with the fluid medium 205 in the inner volume 260 of the casing 250, such that the plurality of beads 200 is free to move about the interior of moldable mattress 105 and/or free to move relative to each other. In a second state, when the fluid medium 205 is evacuated from the inner volume 260 of the casing, for example by a pump system 150, the plurality of beads 200 may be forced to compact and become compressed against each other, the plurality of beads interlocking so as to take on a resilient, gel-like form.

In various embodiments, the supporting frame 110 may further include one or more expansion joints 155, as will be described in further detail below with respect to FIGS. 13-14D, and 16. The expansion joints 155 of the supporting frame 110 may allow the supporting frame to expand in at least one direction, such as a lengthwise or widthwise dimension. In further embodiments, additional expansion joints 155 may be provided to expansion in a plurality of directions, or to provide an expansion of the supporting frame 110 in all directions, capable of maintaining substantially the same shape as when the supporting frame 110 is in a contracted state, or to altogether change the shape of the supporting frame 110 to a different desired shape. As the supporting frame 110 expands, the netted sling 160 may tighten to push upwards against the bottom of the moldable mattress 105, thereby allowing the moldable mattress 105 to expand along with the expansion of the supporting frame 110. In one set of embodiments, the inner volume of the moldable mattress 105, amount of fluid medium, and the number of beads may each be adjusted to create a desired depth of the moldable mattress 105 when fitted to the supporting frame 110. The size of the netted sling 160 may similarly be adjusted change the depth and profile of the moldable mattress 105 within the supporting frame 110.

Figure 16:
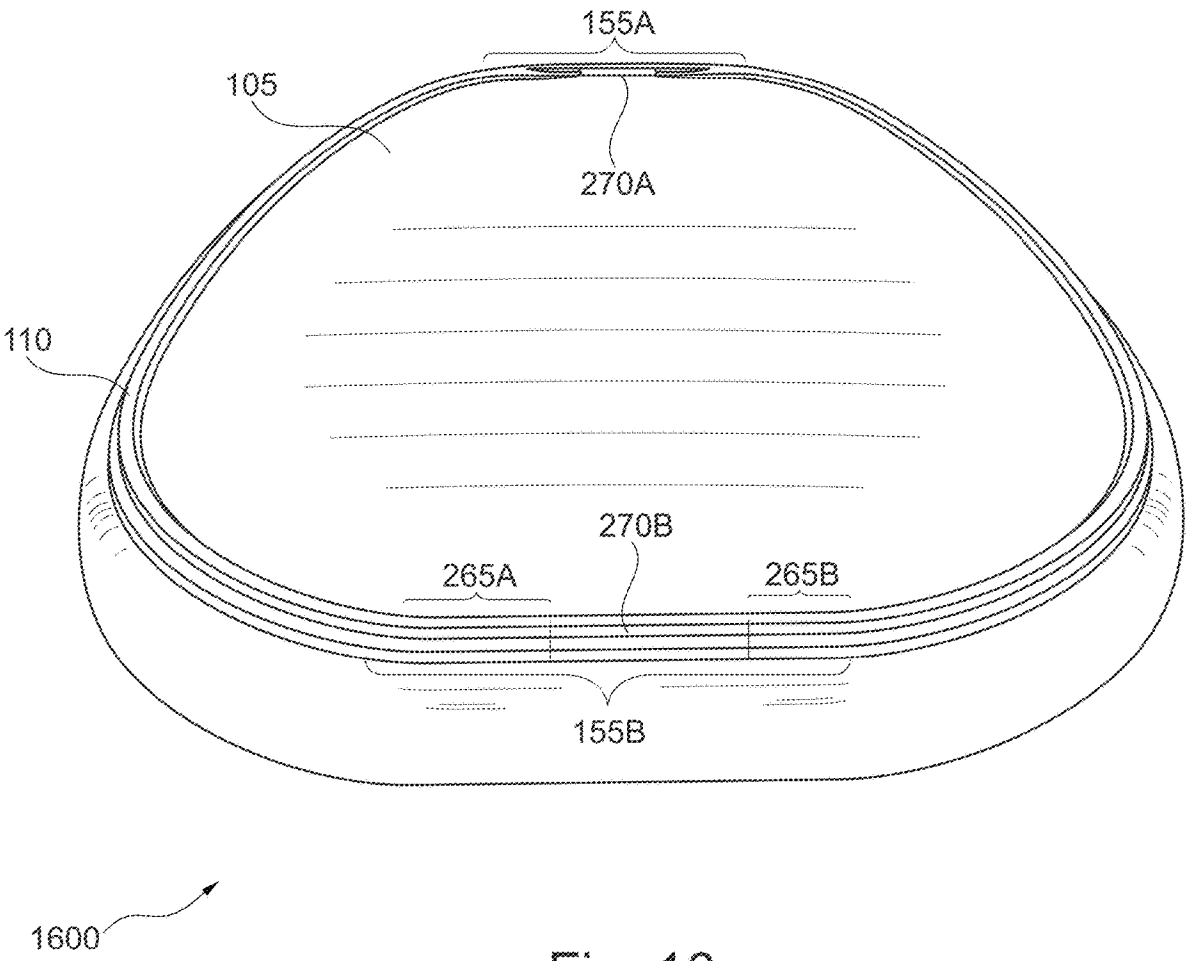
FIG. 16 is a perspective view of the bed system of FIG. 1 in an expanded configuration, in accordance with various embodiments.

FIG. 16 is a perspective view of the bed system 100 in an expanded configuration, according to various embodiments. Here, the moldable mattress 105 has been expanded in the widthwise dimension via two expansion joints 155A, 155B (collectively 155), a first foot-end expansion joint 155A located at a foot-end of the supporting frame 110, and a second head-end expansion joint 155B located at a head-end of the supporting frame 110. In an expanded state, each of the expansion joints 155 may reveal a transition arm 270A, 270B (collectively 270). The transition arm 270B of the head-end expansion joint 155B may be housed within the expansion sleeves 265A, 265B (collectively 265) of the head-end expansion joint 155B, as will be described in more detail below with respect to FIGS. 13-14D. As the expansion joint 155B expands, the left expansion sleeve 265A and right expansion sleeve 265B may slide outwardly around transition arm 270B. When the expansion joint 155B is contracted, the transition arm 270B may retract back into the left and right expansion sleeves 265. The same structures involved in expansion and contraction may be mirrored in the foot-end expansion joint 155A.

FIG. 13 is a cross-sectional view of an expansion joint 155 of a supporting frame 110, according to various embodiments. The expansion joint 155 may include portions of the laterally rigid outer rim 275A, 275B, transition sleeves 265A, 265B, a threaded bolt 280 having a head 295 and retaining nut 300, and control dial 290. According to some embodiments, a left laterally rigid outer rim 275A may include a left transition sleeve 265A. In various embodiments, the left transition sleeve 265A may be configured to contain at least part of the transition arm 270. The transition arm 270 may be slid out of the transition sleeve 265A during expansion of the expansion joint 155, and slid back into transition sleeve 265A when the expansion joint 155 is retracted. These structures are mirrored on a right laterally rigid outer rim 275B, with a right transition sleeve 265B. As depicted, however, the left side support frame portion 275A is shown in an extended position, whereas the right side support frame portion 275B is shown in a retracted position. Accordingly, the transition arm 270 extends out of the left transition sleeve 265A, while the transition arm 270 is still retracted within the right transition sleeve 265B.

In a retracted state, the threaded bolt 280 may be screwed into a retaining nut 300 within the right transition sleeve 265B. In various embodiments, the retaining nut 300 may be configured to be stationary relative to the rotation of the threaded bolt 280. In other embodiments, the right laterally rigid outer rim 275B may include a threaded hole into which the threaded bolt 280 may be screwed, instead of, or in addition to, the retaining nut 300. Accordingly, the control dial 290 may be rotated in a first direction to cause the threaded bolt 280 to screw into the retaining nut 300, causing the expansion joint 155 to retract. The control dial 290 may correspondingly be rotated in the opposite direction to cause the threaded bolt 280 to unscrew out of the retaining nut 300, causing the expansion joint 155 to expand.

Lines A-A, B-B, C-C, and D-D corresponds to various cross sections illustrated in FIGS. 14A-14D. FIG. 14A corresponds to a section taken at line A-A, FIG. 14B corresponds to a section taken at line B-B excluding the threaded bolt 280, FIG. 14C corresponds to a section taken at line C-C, and FIG. 14D corresponds to a section taken at line D-D.

Similar to FIG. 12, FIG. 14A depicts a cross section 1400A of the laterally rigid outer rim 275 of the supporting frame 110. According to various embodiments, on the outside 310 of the laterally rigid outer rim 275, the laterally rigid outer rim 275 includes an outer attachment point 245A for a fastening bungee 235, such as a fastening bungee 135 for a moldable mattress 105. The inside 315 of the laterally rigid outer rim 275 may correspondingly include an inner attachment point 245B for a fastening bungee 235, such as a fastening bungee 235 for a netted sling 160.

According to some embodiments, the section of the laterally rigid outer rim 275 may further include a hollow cavity 305, to reduce the weight and cost of the supporting frame 110. The section of the laterally rigid outer rim 275 may further include a lower cavity 330. In various embodiments, the lower cavity 330 may be configured to guide a threaded expansion bolt 280 of the expansion joint 155. In other embodiments, the lower cavity 330 may alternatively or additionally provide further reductions in weight and cost.

The supporting frame 110 may also include one or more mounting tracks 255. According to various embodiments, the one or more mounting tracks 255 may be configured to support one or more peripheral attachments, to couple to one or more control arm connectors 165, or to couple to a gurney transfer support 230, as described in more detail below.

The laterally rigid outer rim 275 may additionally include a plurality of alignment keys 320. The alignment keys 320 may aid in the alignment of the laterally rigid outer rim 275 with the other parts of the expansion joint 155, like the transition arm 270 or transition sleeve 265.

Figure 14B:
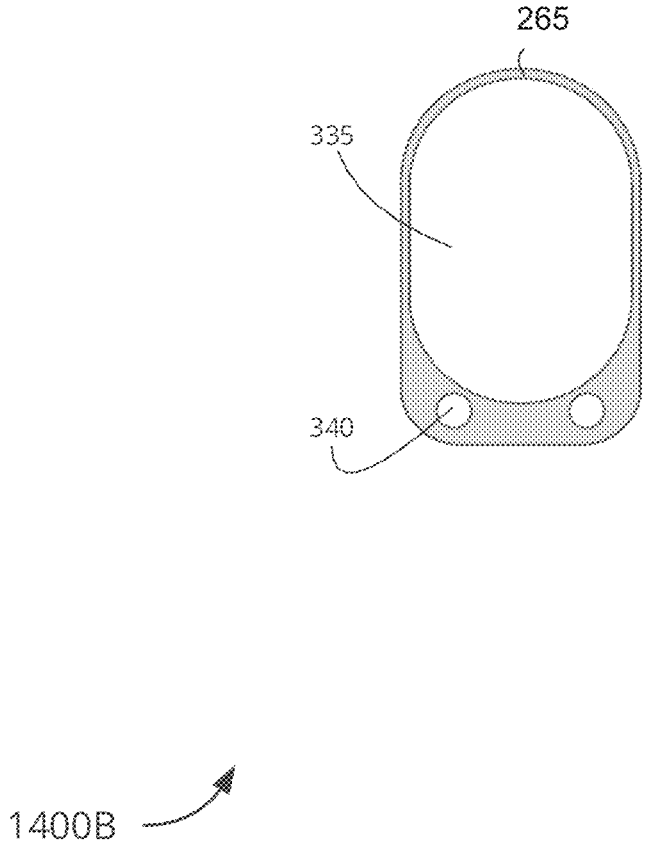
FIG. 14B is a transverse cross-sectional view of a transition sleeve of a supporting frame expansion joint for use with the bed system of FIG. 1, in accordance with various embodiments.

FIG. 14B depicts a cross section 1400B of the transition sleeve 265. According to various embodiments, the transition sleeve 265 may include receiving cavity 335 and alignment keys 340. According to various embodiments, the receiving cavity 355 may be configured to hold a transition arm 270 while allowing the transition arm 270 to slide into and out of the transition sleeve 265 during expansion and contraction. The alignment keys 340 may be utilized to align the transition sleeve 265 to one or more of the laterally rigid outer rim 275, another transition sleeve 265, or the transition arm 270.

Figure 14C:
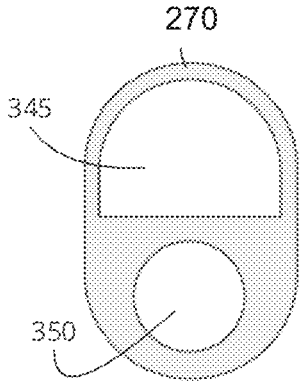
FIG. 14C is a transverse cross-sectional view of a transition arm of a supporting frame expansion joint for use with the bed system of FIG. 1, in accordance with various embodiments.

FIG. 14C depicts a cross section 1400C of the transition arm 270. According to various embodiments, the transition arm 270 may include a hollow cavity 345, as well as a keyhole cavity 350 for a threaded expansion bolt 280. Like the cavities 305, 330 in the laterally rigid outer rim 275, hollow cavity 345 may similarly be utilized to reduce the weight and cost of the transition arm 270. The keyhole cavity 350 may be configured to receive and guide the threaded expansion bolt 280. In some embodiments, the keyhole cavity 350 may also be threaded, while in other embodiments, the keyhole cavity 350 may have a smooth interior, allowing the transition arm 270 to freely slide along the threaded expansion bolt 280, and within the transition sleeves 265.

Figure 14D:
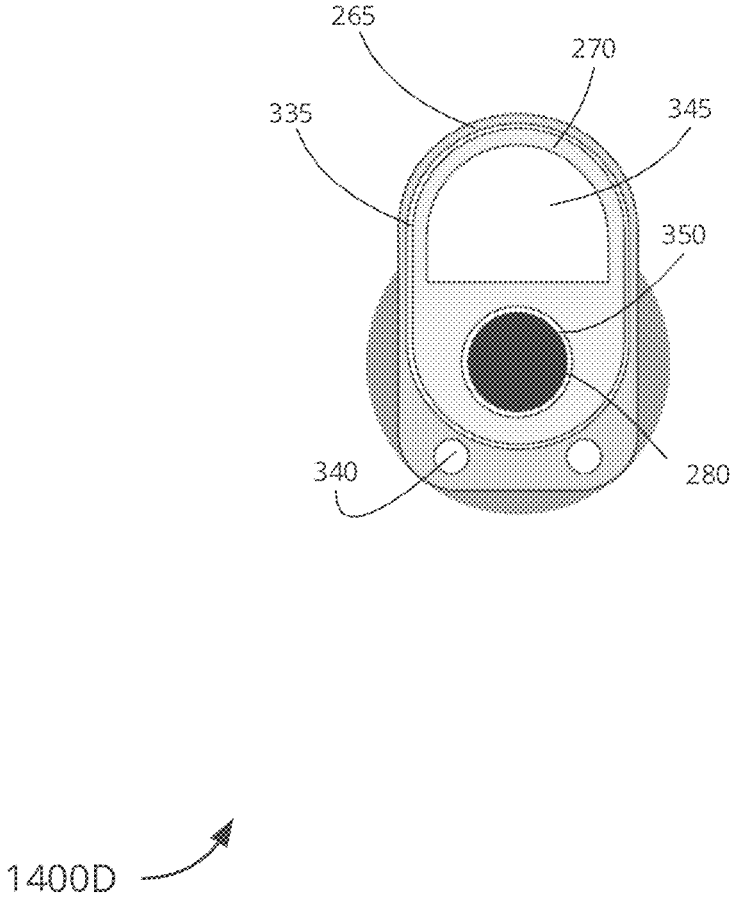
FIG. 14D is a transverse cross-sectional view of a supporting frame expansion joint for use with the bed system of FIG. 1, in accordance with various embodiments.

FIG. 14D depicts a cross section 1400D of the transition arm 270 seated within the transition sleeve 265, and a threaded expansion bolt 280 seated within the keyhole cavity 350, in accordance with various embodiments. The section 1400D illustrates how the transition arm 270 may be seated within the receiving cavity 335 of the transition sleeve 265, according to some embodiments.

According to various embodiments, the control arms 135 of the gimballing base 130 may couple to the supporting frame 110 via control arm connectors 165. The control arm connectors 165 may be attached to the supporting frame 110 in a releasable manner utilizing a suitable connector and locking mechanism. For example, the control arm connectors 165 may use, without limitation, hooks and loops, clamps, friction or tension, adhesives, or a track wheel or sliding track attachment. In one set of embodiments, the control arms 135 may restrict movement of the supporting frame 110 relative to the gimballing plate 115 while allowing movement for the expansion or contraction of the supporting frame 110. In some embodiments, once the supporting frame 110 has been adjusted to the desired size, the control arms may then be locked to restrict all movement relative to the gimballing plate 115.

Figure 10:
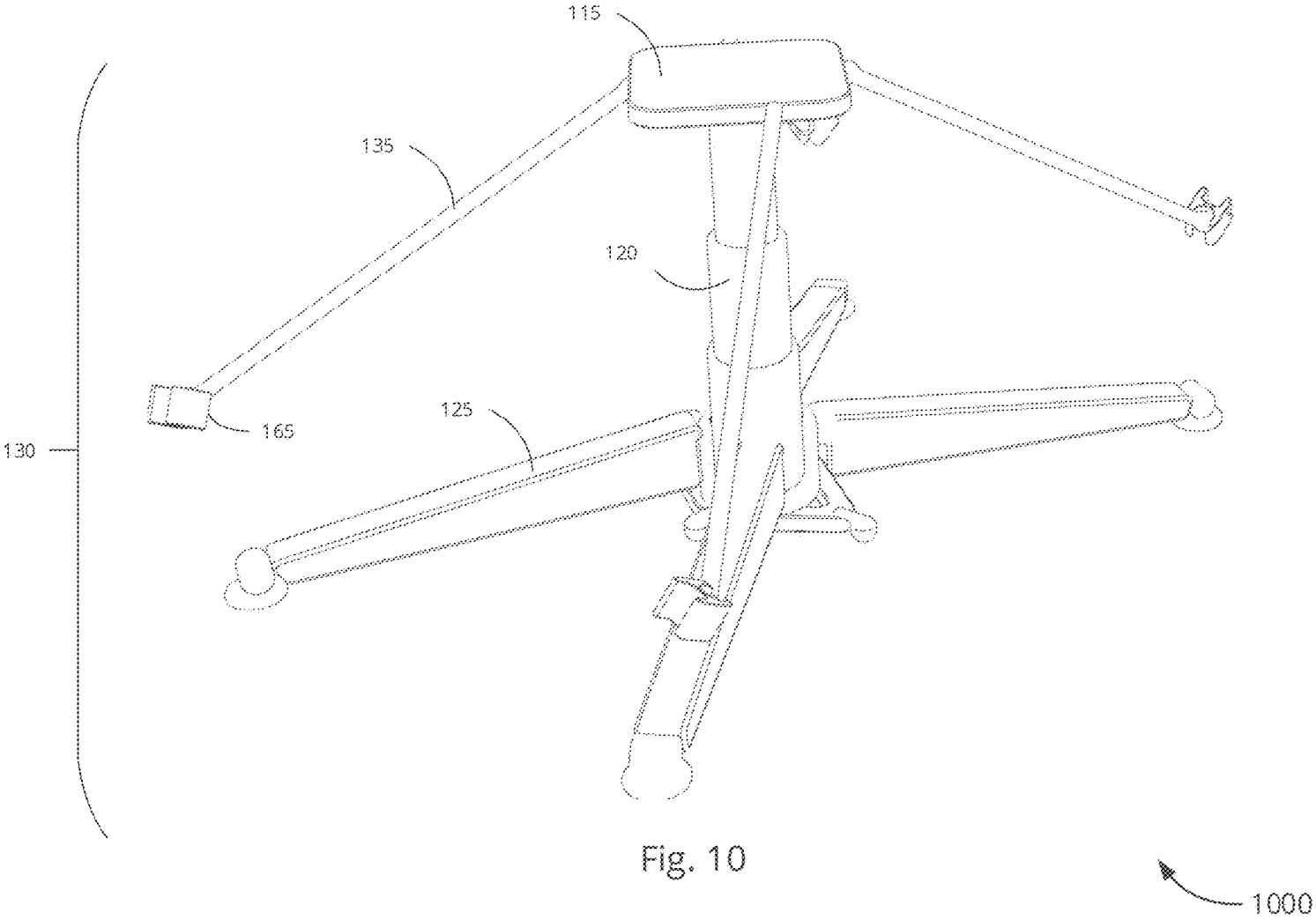
FIG. 10 is a perspective view of a gimballing base of a bed system of FIG. 1, in accordance with various embodiments.

According to various embodiments, the supporting frame 110 may be attached to a gimballing base 130. The gimballing base 130 may include a gimballing plate 115, telescoping post 120, base legs 125, control arms 135, and control arm connectors 165. For example, FIG. 2 provides an exploded view 200 of the bed system 100, in accordance with various embodiments. In the exploded view, the netted sling 160 and control arms 135 with control arm attachments 165 are clearly visible, as well as the order in which each component of the bed system 100 is arranged. FIG. 10 provides a perspective view 1000 of a gimballing base 130, in accordance with various embodiments. In various embodiments, the control arms 135 may be coupled to gimballing plate 115, and further be coupled to a supporting frame 110 via their respective control arm connectors 165. The control arms 135 may be configured to limit or restrict motion relative to the gimballing plate 115. In one set of embodiments, the control arms 135 may be movably attached to the gimballing plate 115, but provided with a locking mechanism to lock the movement and positioning of the control arms 135. In other embodiments, the control arms 135 may be restricted altogether from moving in at least one direction relative to the gimballing plate 115. For example, in one set of embodiments, the control arm 135 may be free to move up and down, but not side to side. In other embodiments, the control arms 135 may be configured to move in all directions, but the range of motion of the control arms 135 may be restricted. In further embodiments, the control arms 135 may restrict all movement of the supporting frame 110 relative to the gimballing plate 115. In various embodiments, the control arms may couple to the supporting frame 110 via the control arm connectors attaching to the mounting track 255.

In an alternative set of embodiments, the gimballing plate 115 may instead be a stationary support plate to which the control arms 135 may be operably coupled. The control arms 135 may then be configured to move the support frame 110 to a desired position. Accordingly, the control arms 135 may be actuated by a driver, such as, without limitation, a 2-axis ball screw mechanism, a rack and pinion, chain sprocket, or direct drive motor. Thus, the control arms 135 may be able to move the supporting frame 110 in any direction, like corresponding embodiments utilizing the gimballing plate 115.

In various embodiments, the gimballing plate 115 may be configured to gimbal in three axes. Thus, the gimballing plate 115 may control any of tilt, tip, and rotation of the supporting frame 110 and moldable mattress 105. In one set of embodiments, the telescoping post 120 may extend and retract, allowing the moldable bed 105 and supporting frame 110 to be raised and lowered. In various embodiments, the telescoping post 120 may be lowered to allow any edge of the moldable mattress 105 and supporting frame 110 to be tilted near the ground, for example, to within 1 inch of the ground. In various embodiments, when a patient is first positioned on the moldable mattress 105, the telescoping post 120 may lower moldable mattress 105 while the gimballing base 115 tilts the moldable mattress 105 towards the patient, helping the patient get onto the moldable mattress 105, and the caregiver in positioning the patient on the moldable mattress 105.

Figure 11:
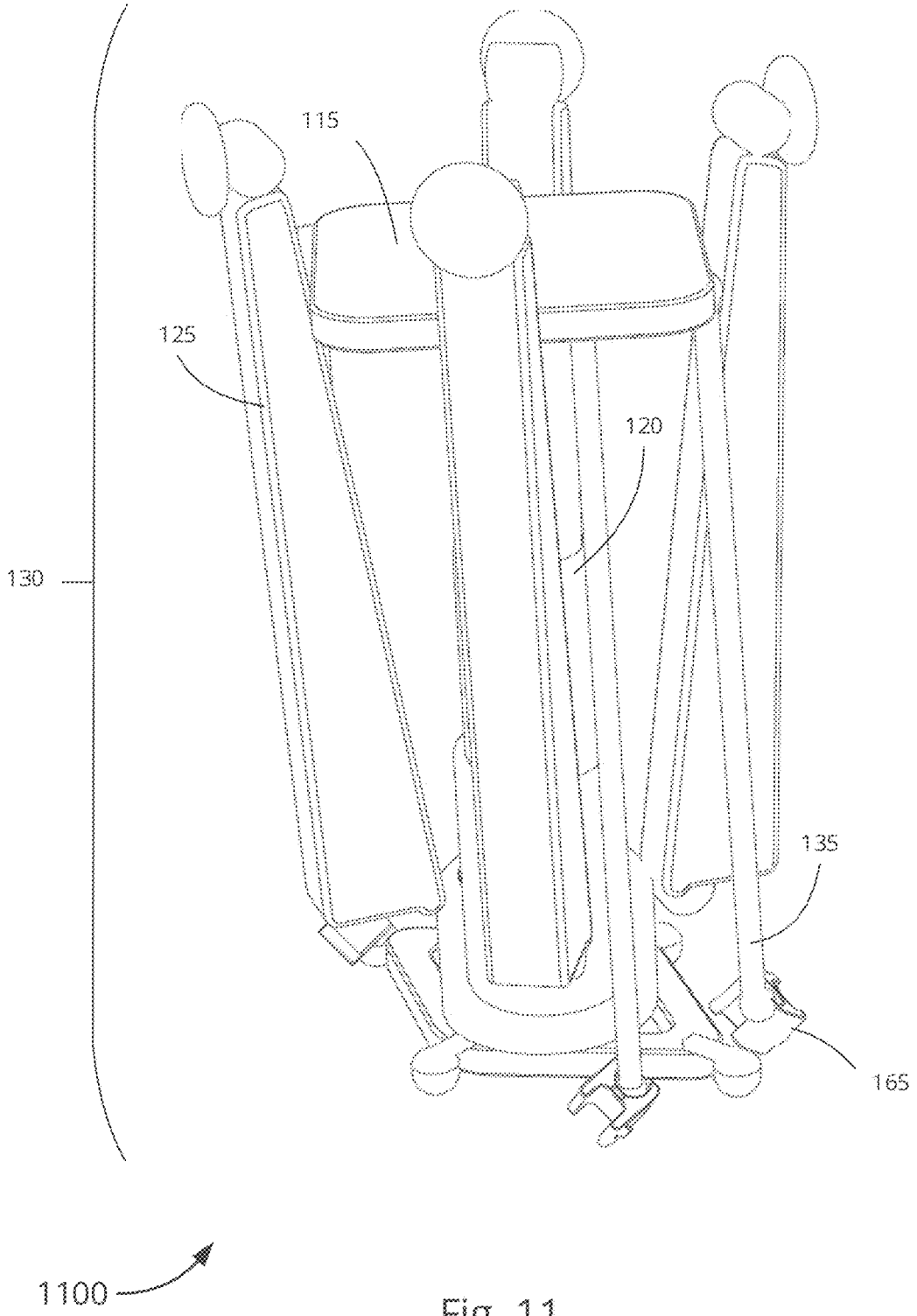
FIG. 11 is a perspective view of the gimballing base of FIG. 10 in a stowing configuration, in accordance with various embodiments.

When the moldable bed 105 and supporting frame 110 are detached from the control arms 135, the gimballing base 130 may be placed in a stowing configuration, where the base legs 125 may be raised, and the control arms 135 lowered, allowing the gimballing base 130 to be folded, as seen in FIG. 11. FIG. 11 provides a perspective view 1100 of the gimballing base 130 in a stowing configuration. In various embodiments, when the gimballing base 130 is in the stowing configuration, the control arms 135 may be folded down beside or underneath the gimballing plate 115. In some embodiments, the control arms 135 may themselves have telescoping functionality, able to collapse inwards and be folded away. Similarly, the base legs 125 may be folded up in the stowing configuration. In this manner, the gimballing base 130 may be placed into a stowing configuration to minimize its physical footprint. According to some embodiments, the base legs 125 may be on stationary feet, while in other embodiments wheeled feet may be provided, such as castors or other wheels. In yet further embodiments, both a wheeled base and base legs 125 may be provided, allowing the gimballing base 130 to be wheeled when the base legs 125 are raised and stationary when the base legs 125 are lowered.

Figure 15:
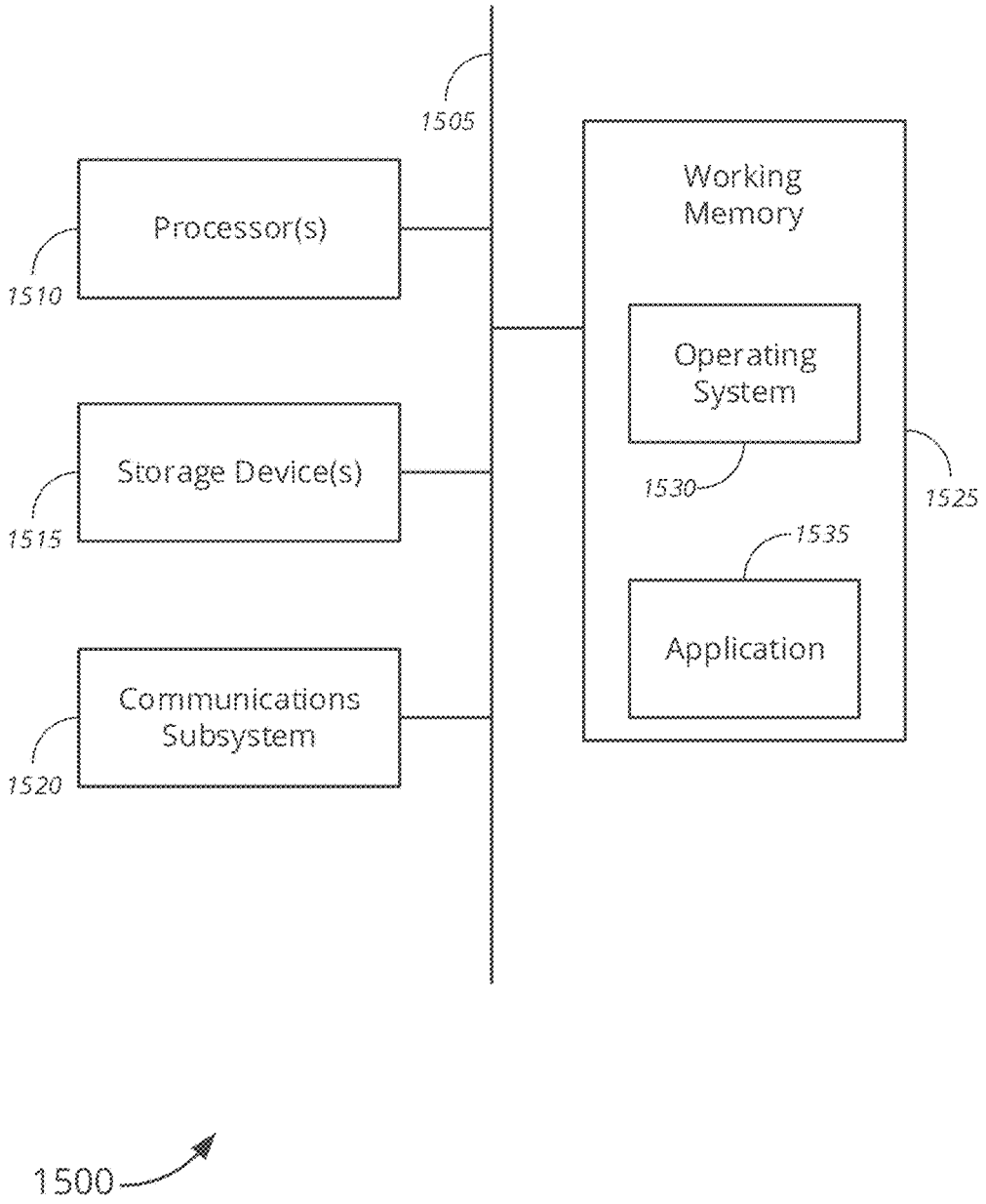
FIG. 15 is a schematic block diagram of computer hardware for a control system for the bed system of FIG. 1, in accordance with various embodiments.

According to other embodiments, the gimballing plate 115 may be in communication with a control system 1500, as described with respect to FIG. 15, for controlling the movement of the bed. The control system 1500 may actuate various drivers for moving the gimballing plate 115, such as, without limitation, a 2-axis ball screw mechanism, a rack and pinion, chain sprocket, or direct drive motor. These drivers may actuate the gimballing plate 115 that is mounted to the gimballing base 130 via, without limitation, a universal joint, ball joint, or other suitable gimballing connection, as will be known to those in the art.

Figure 6A:
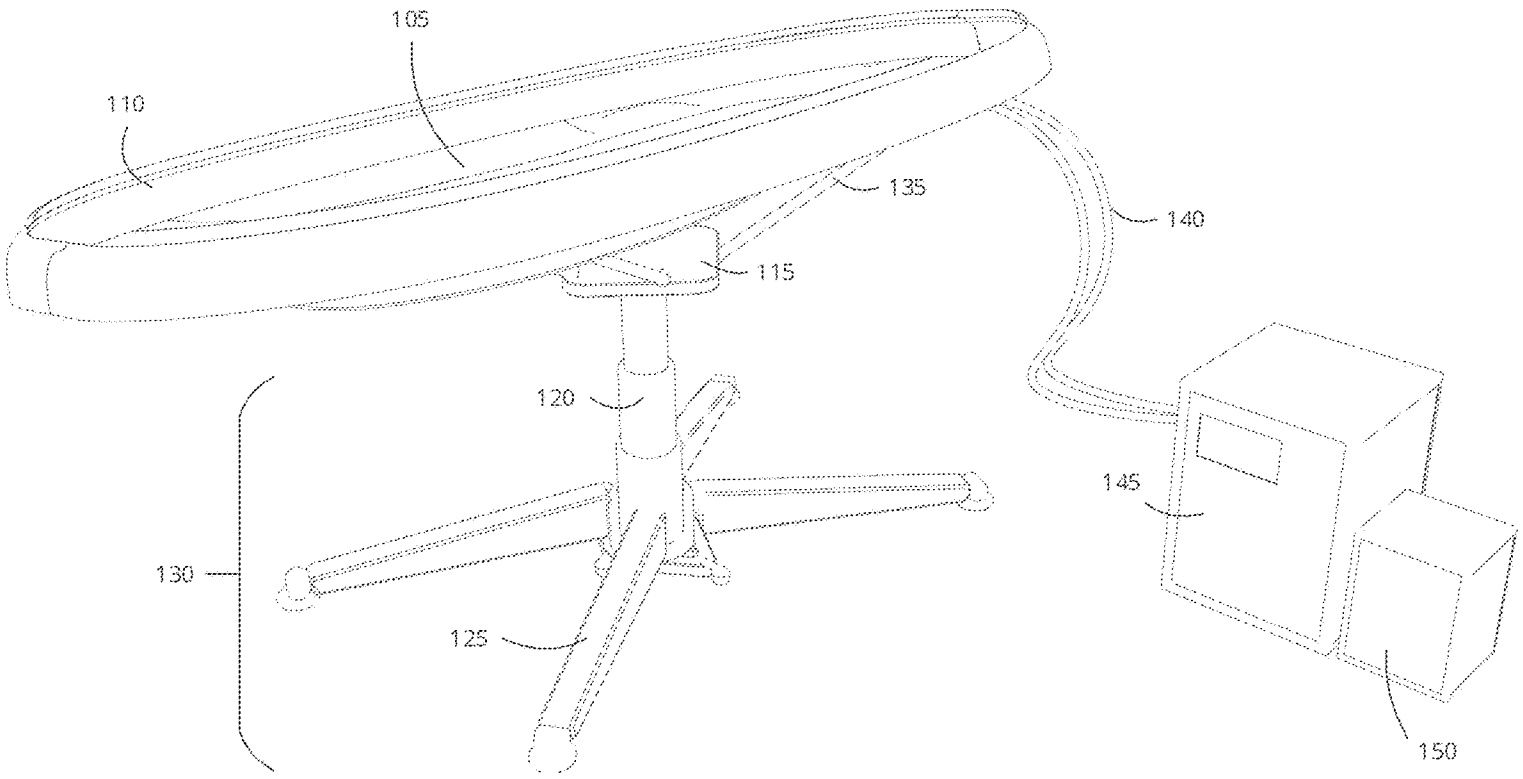
FIGS. 6A-6B are side perspective views of the bed system of FIG. 1 in a tilted configuration, in accordance with various embodiments.
Figure 6B:
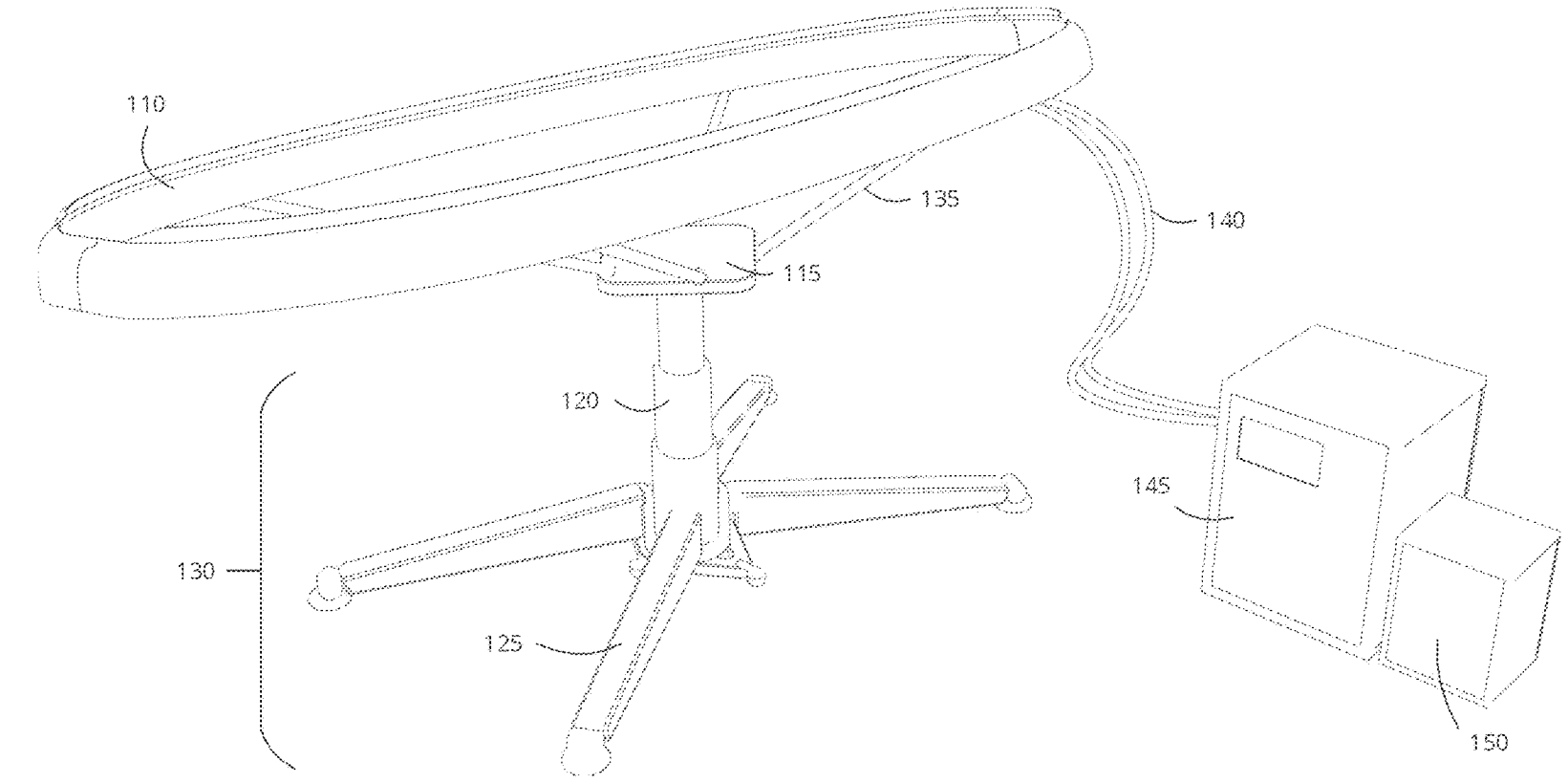

FIGS. 6A-6B illustrate a side perspective view, both with and without a moldable mattress 105 in a supporting frame 110, illustrating the tilting feature. FIG. 6A provides the side perspective view 600A of the bed system 100, having a moldable mattress 105 attached to a supporting frame 110. This side perspective view illustrates the moldable mattress 105 and supporting frame 110 in a tilted configuration. Depressions 170 are visible in the moldable mattress 105, as well as the hammock effect at the bottom of the molded mattress 105, as created when the moldable mattress 105 hangs from the supporting frame 110, and is supported by a netted sling 160.

FIG. 6B better illustrates the relationship between the supporting frame 110, control arms 135, and gimballing plate 115 in a tilted configuration. In this view 600B, the moldable mattress 105 is removed from view to better show the control arms 135 in relation to the supporting frame 110.

Figure 7A:
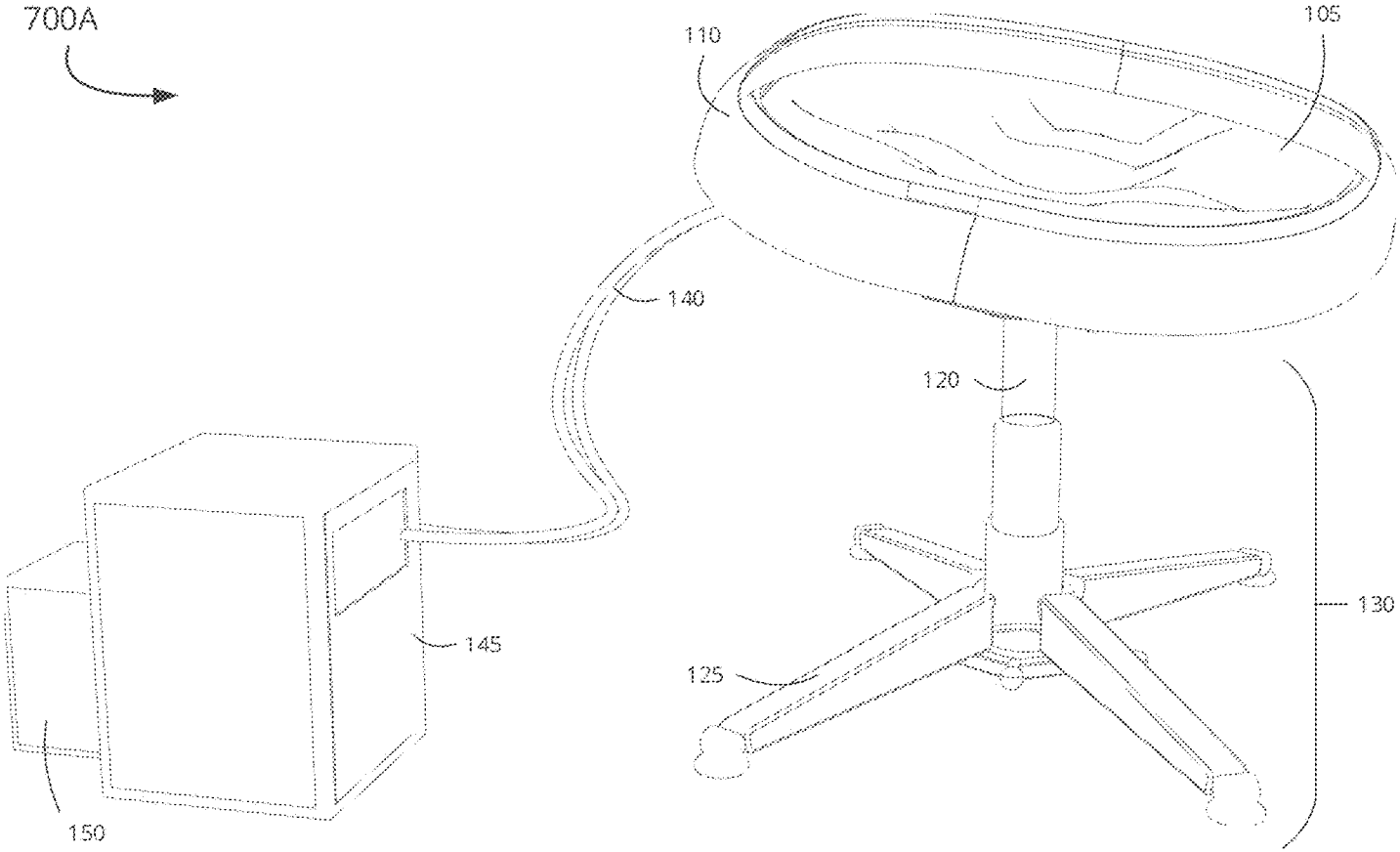
FIGS. 7A-7B are front perspective views of the bed system of FIG. 1 in a tilted configuration, in accordance with various embodiments.
Figure 7B:
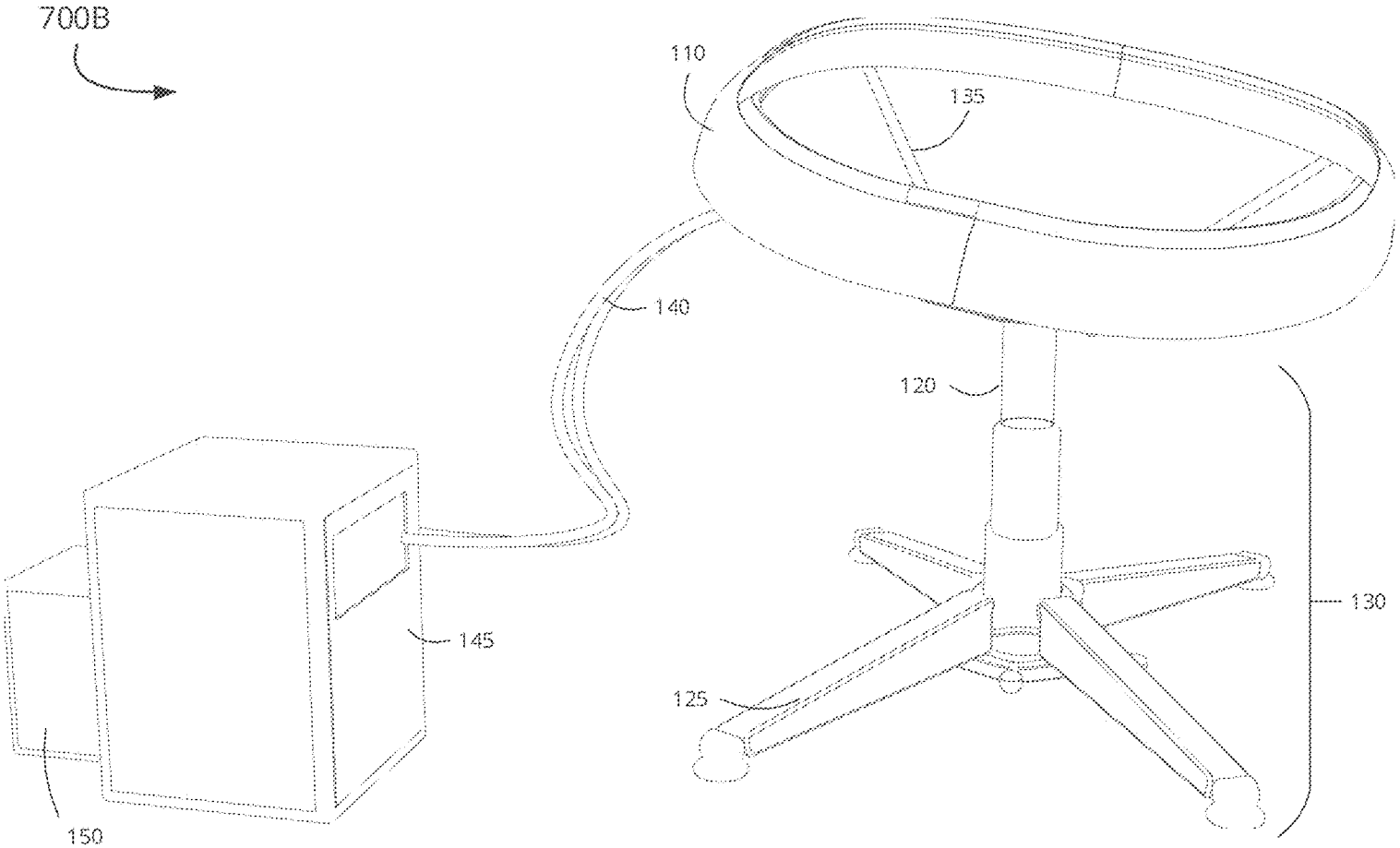

FIGS. 7A-7B provide a front perspective view, both with and without a moldable mattress 105 in a supporting frame. FIG. 7A is a front perspective view 700A of a bed system 100, having a moldable mattress 105 attached to a supporting frame 110. This front perspective view 700A illustrates the moldable mattress 105 and supporting frame 710 in a similar tilted configuration to those depicted in FIGS. 6A & 6B. Depressions 170 are again visible in the moldable mattress 105. As in FIGS. 6A & 6B, a hammock effect may be created as the moldable mattress 105 hangs from the supporting frame 110, and is supported by a netted sling 160. In various embodiments, with the tendency of the moldable mattress 105 to have a rounded bottom, when the patient is tilted downward into a seated position, the moldable mattress 105 may be cradled by the sling to form a natural seating shape to support the patient's legs and back.

FIG. 7B illustrates the front perspective view 700B without the moldable mattress 105. Here, the control arms 135 are visible, coupled to the supporting frame 110, and extending from the gimballing plate 115.

With reference to FIG. 15, the control system 1500 may include a processor 1510, system memory 1525, a storage device 1515, display, one or more user interfaces, and a communications subsystem 1520. The control system 1500 may be controlled through controls on the moldable bed system 100, through a wired or wireless controller, or remotely by a caregiver. In various embodiments, the control system 1500 may communicate with the gimballing plate 115 directly or via a communications network. According to various embodiments, the control system 1500 may be configured to tilt, tip, or rotate the hospital bed according to user input, through a pre-programmed routine, or based on detected conditions. For example, the patient may be rotated about a longitudinal axis, running down the length of the moldable mattress 105 from the head of the patient to the patient's feet, creating a tilt-tip motion in the left and right direction from the patient's perspective. The patient may also be rotated about a transverse axis, going across moldable mattress 105 from the left side of the patient to the right side of the patient. This creates a tilt-tip motion in the up and down direction from the patient's perspective. The patient may also be rotated around a vertical axis. Accordingly, the gimballing plate 115 may gimbal in three axes, allowing the moldable mattress 105 and supporting frame 110 to rotate, tilt, and tip in any direction.

In various embodiments, the control system 1500 may be pre-programmed with a routine to move the moldable mattress 105 and supporting frame 110 gradually through a series of positions. In various embodiments, one or more pre-programmed routines may be provided and stored by the control system 1500 in the storage device 1515 or working memory 1525. In alternative or additional embodiments, the one or more pre-programmed routines may be stored remotely at a database or on a server accessible to the control system 1500. The one or more pre-programmed routines may be configured to address common problem areas for bedsores, or tailored to specific sores on individual patients. For example, pre-programmed routines may include, without limitation, a sacrum sore cycle, a buttocks sore cycle, a left side sore cycle, a right side sore cycle, a back of the head sore cycle, a shoulder sore cycle, hip sore cycle, a lower back sore cycle, a greater trochanter sore cycle, elbow sore cycle, heel sore cycle, a knee sore cycle, or a combination of these cycles. In each of these cycles, the control system 1500 may move the bed system 100 to avoid placing pressure on the areas of the patient associated with these common sores. In further embodiments, the control system 1500 may also utilize a pressure ulcer prevention cycle. The prevention cycle may slowly and continuously move the patient through a series of positions such that no single position is repeated for a given amount of time, for example, 2 hours. In one set of embodiments, the movement through the prevention cycle may be so gradual as to be nearly imperceptible to the patient. In some embodiments, the routine may be a series of randomized positions, while in other embodiments, the routine may cycle a through a defined series of positions. Thus, the gimballing plate 115 may constantly be in motion, continually changing the position of the individual to avoid prolonged pressure from being applied to the skin.

In some further embodiments, the control system 1500 may further control the pump system 150. The control system 1500 may be configured evacuate waste on a programmed schedule, on demand based on user input, continuously evacuate the evacuation header 195, or respond to changes detected by one or more sensors. The one or more sensors may include, without limitation, moisture sensors, pressure sensors, temperature sensors, flow sensors, leak sensors, photodetectors, or any other suitable sensors for detecting environmental changes on any of the moldable mattress 105, the top compliant surface 175, evacuation tubes 190, or evacuation header 195. In some embodiments, the one or more sensors may further include one or more patient sensors—including, but not limited to, an oximeter, a blood pressure sensor, heart-rate or pulse monitor, or the like—that monitor the patient's status and responses, particularly a tip-tilt cycle.

In some further embodiments, the control system 1500 may also be utilized to control the temperature of the fluid medium 205, or to operate the pump system 150 to fill and evacuate the fluid medium 205 from the moldable mattress 105.

Figure 9:
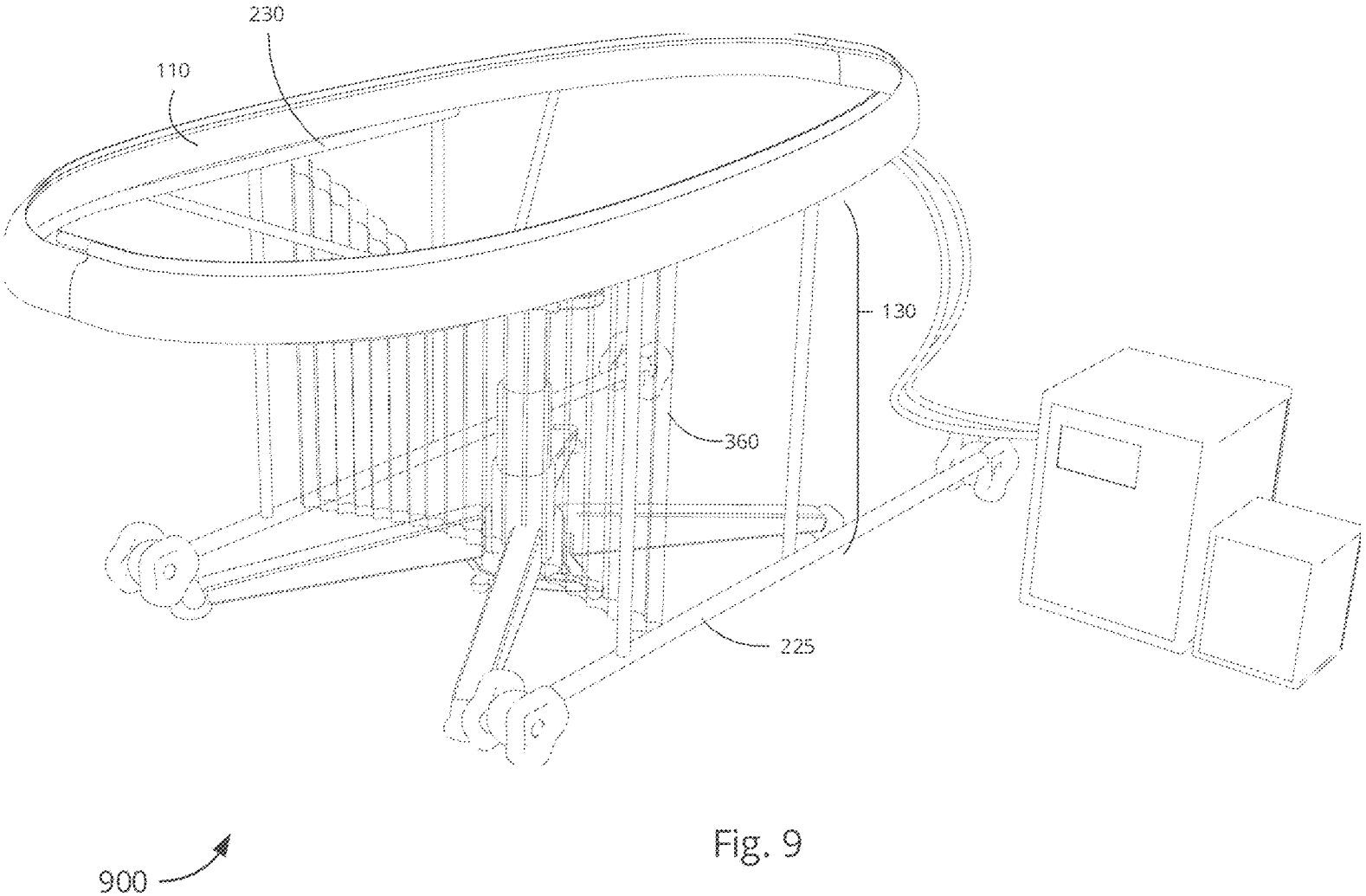
FIG. 9 is a perspective view of a gurney attachment configuration of the bed system of FIG. 1, in accordance with various embodiments.

FIG. 9 illustrates a perspective view of a gurney attachment configuration 900 of the bed system 100, in accordance with various embodiments. The system 100 may include a gurney base 225, supporting frame 110, gurney transfer support 230, bellows expansion support 360, and gimballing base 130. The system 900 is depicted without a moldable mattress 105 to better illustrate the gurney transfer support 230 in relation to the supporting frame 110.

According to various embodiments, the gurney transfer support 230 may attach to a mounting track 255 of the supporting frame 110, as discussed with respect to the embodiments above. Once the gurney transfer support 230 is coupled to the supporting frame 110, the control arms 135 of the gimballing base 130 may be detached from the supporting frame 110. Thus, the gurney base 225 and gurney transfer support 230 may fully support the weight of the supporting frame 110, moldable mattress 105, and patient. Once the gimballing base 130 has been detached from the supporting frame 110, the patient may be wheeled to another area. Similarly, once a destination has been reached, a gimballing base 130 may be brought to the gurney, and the control arms 135 attached to the supporting frame 110. Once the supporting frame 110 has been attached to the control arms 135, the gurney transfer support 230 may be detached from the supporting frame 110. In some embodiments, where the supporting frame 110 is in an expanded configuration, the gurney transfer support 230 may be expanded to successfully mate to the expanded support frame 110. A bellows expansion support 360 may be provided to expand with the gurney transfer support 230. In various embodiments, the bellows expansion support 360 may be configured to be expandable in a lateral (i.e. widthwise) direction, while providing rigid vertical support between the gurney transfer support 230 and gurney base 225.

FIG. 15 is a schematic block diagram of a computer architecture for a control system 1500 for a bed system 100, in accordance with various embodiments. FIG. 15 provides a schematic illustration of one embodiment of a computer system 1500 that can perform methods provided by various other embodiments, as described herein, and/or can perform the functions of the control system, pumping system, application server, user device, on-board controller, remote controller, or any other computer systems as described above. It should be noted that FIG. 15 is meant only to provide a generalized illustration of various components, of which one or more (or none) of each may be utilized as appropriate. FIG. 15, therefore, broadly illustrates how individual system elements may be implemented in a relatively separated or integrated manner.

The computer system 1500 includes a plurality of hardware elements that can be electrically coupled via a bus 1505 (or may otherwise be in communication, as appropriate). The hardware elements may include one or more processors 1510, including, without limitation, one or more general-purpose processors and/or one or more special-purpose processors (such as digital signal processing chips, graphics acceleration processors, and/or the like). In general, embodiments can employ as a processor any device, or combination of devices, that can operate to execute instructions to perform functions as described herein. Merely by way of example, and without limitation, any microprocessor (also sometimes referred to as a central processing unit, or CPU) can be used as a processor, including without limitation one or more complex instruction set computing (CISC) microprocessors, such as the single core and multicore processors available from Intel Corporation™ and others, such as Intel's X86 platform, including, e.g., the Pentium™, Core™, and Xeon™ lines of processors. Additionally and/or alternatively, reduced instruction set computing (RISC) microprocessors, such as the IBM Power™ line of processors, processors employing chip designs by ARM Holdings™, and others can be used in many embodiments. In further embodiments, a processor might be a microcontroller, embedded processor, embedded system, SoC or the like.

As used herein, the term "processor" can mean a single processor or processor core (of any type) or a plurality of processors or processor cores (again, of any type) operating individually or in concert. Merely by way of example, the computer system 1500 might include a general-purpose processor having multiple cores, a digital signal processor, and a graphics acceleration processor. In other cases, the computer system might 1500 might include a CPU for general purpose tasks and one or more embedded systems or microcontrollers, for example, to run real-time functions. The functionality described herein can be allocated among the various processors or processor cores as needed for specific implementations. Thus, it should be noted that, while various examples of processors 1510 have been described herein for illustrative purposes, these examples should not be considered limiting.

The computer system 1500 may further include, or be in communication with, one or more storage devices 1515. The one or more storage devices 1515 can comprise, without limitation, local and/or network accessible storage, or can include, without limitation, a disk drive, a drive array, an optical storage device, a solid-state drive, flash-based storage, or other solid-state storage device. The solid-state storage device can include, but is not limited to, one or more of a random access memory (RAM) or a read-only memory (ROM), which can be programmable, flash-updateable, or the like. Such storage devices may be configured to implement any appropriate data stores, including, without limitation, various file systems, database structures, or the like.

In some embodiments, pre-programmed movement routines, schedules, waste removal instructions, temperature control instructions, and other similar control instructions may be stored in the storage device 1515. The control instructions data may subsequently be accessed, modified, or downloaded from the storage device 1515 by the patient, a caregiver, physician, or other user.

The computer system 1500 might also include a communications subsystem 1520, which can include, without limitation, a modem, a network card (wireless or wired), a wireless programmable radio, or a wireless communication device. Wireless communication devices may further include, without limitation, a Bluetooth device, an 802.11 device, a WiFi device, a WiMax device, a WWAN device, cellular communication facilities, or the like. The communications subsystem 1520 may permit data to be exchanged with an application server, remote user device, a remote control, wired or on-board controls, or combination of the above devices, as described with respect to the embodiments above. The communications subsystem 1520 may also permit data to be exchanged with other computer systems, and/or with any other devices described herein, or with any combination of network, systems, and devices. According to some embodiments, the network might include a local area network (LAN), including without limitation a fiber network, or an Ethernet network; a wide-area network (WAN); a wireless wide area network (WWAN); a virtual network, such as a virtual private network (VPN); the Internet; an intranet; an extranet; a public switched telephone network (PSTN); an infra-red network; a wireless network, including without limitation a network operating under any of the IEEE 802.11 suite of protocols, the Bluetooth protocol, or any other wireless protocol; or any combination of these or other networks.

In many embodiments, the computer system 1500 will further comprise a working memory 1525, which can include a RAM or ROM device, as described above. The computer system 700 also may comprise software elements, shown as being currently located within the working memory 1525, including an operating system 1530, device drivers, executable libraries, and/or other code. The software elements may include one or more application programs 1535, which may comprise computer programs provided by various embodiments, and/or may be designed to implement methods and/or configure systems provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be encoded and/or stored on a non-transitory computer readable storage medium, such as the storage device(s) 1525 described above. In some cases, the storage medium might be incorporated within a computer system, such as the system 1500. In other embodiments, the storage medium might be separate from a computer system (i.e., a removable medium, such as a compact disc, etc.), and/or provided in an installation package, such that the storage medium can be used to program, configure and/or adapt a general purpose computer with the instructions/code stored thereon. These instructions might take the form of executable code, which is executable by the computer system 1500 and/or might take the form of source and/or installable code, which, upon compilation and/or installation on the computer system 1500 (e.g., using any of a variety of generally available compilers, installation programs, compression/decompression utilities, etc.) then takes the form of executable code.

It will be apparent to those skilled in the art that substantial variations may be made in accordance with specific requirements. For example, customized hardware (such as programmable logic controllers, field-programmable gate arrays, application-specific integrated circuits, and/or the like) might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 1500) to perform and control functions in accordance with various embodiments of the invention. According to a set of embodiments, some or all of the procedures are performed by the computer system 1500 in response to processor 1510 executing one or more sequences of one or more instructions (which might be incorporated into the operating system 1530 and/or other code, such as an application program 1535) contained in the working memory 1525. Such instructions may be read into the working memory 1525 from another computer readable medium, such as one or more of the storage device(s) 1515. Merely by way of example, execution of the sequences of instructions contained in the working memory 1525 might cause the processor(s) 1510 to perform one or more procedures of the embodiments described herein.

The terms "machine readable medium" and "computer readable medium," as used herein, refer to any medium that participates in providing data that causes a machine to operate in a specific manner. In an embodiment implemented using the computer system 1500, various computer readable media might be involved in providing instructions/code to processor(s) 1510 for execution and/or might be used to store and/or carry such instructions/code (e.g., as signals). In many implementations, a computer readable medium is a non-transitory, physical and/or tangible storage medium. In some embodiments, a computer readable medium may take many forms, including but not limited to, non-volatile media, volatile media, or the like. Non-volatile media includes, for example, optical and/or magnetic disks, such as the storage device(s) 1515. Volatile media includes, without limitation, dynamic memory, such as the working memory 1525.

Common forms of physical and/or tangible computer readable media include, for example, a floppy disk, a flexible disk, a hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read instructions and/or code.

Various forms of computer readable media may be involved in carrying one or more sequences of one or more instructions to the processor(s) 1510 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 1500. These signals, which might be in the form of electromagnetic signals, acoustic signals, optical signals and/or the like, are all examples of carrier waves on which instructions can be encoded, in accordance with various embodiments of the invention.

The communications subsystem 1520 (and/or components thereof) generally will receive the signals, and the bus 1505 then might carry the signals (and/or the data, instructions, etc. carried by the signals) to the processor(s) 1510, or working memory 1525, from which the processor(s) 1510 retrieves and executes the instructions. The instructions received by the working memory 1525 may optionally be stored on a storage device 1515 either before or after execution by the processor(s) 1510.

According to a set of embodiments, a user (such as a caregiver, physician, medical specialist, or nurse) may access the control system 1500 via a user interface of the control system, or alternatively, access the control system remotely via a communications network through their own user device. Suitable user devices may include, without limitation, a desktop computer, a laptop computer, a tablet computer, a smart phone, a mobile phone, a personal digital assistant ("PDA"), or a remote control device, and the like. In some cases, the user device may be communicatively coupled to the communications subsystem of the control system either wirelessly (e.g., according to any of the IEEE 802.11 suite of protocols, the Bluetooth™ protocol, or any other wireless protocol) or via wired connection. In some examples, user device may interact with the control system via a secure website or web application hosted on an application server. Thus, the application server may be in communication with the control system via a communications network, and the user may gain access to the control system through the application server.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture but instead can be implemented on any suitable hardware, firmware and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A moldable mattress comprising:

a casing comprising a bladder defining an inner volume;

a plurality of beads within the inner volume; wherein:

the bladder is configured so that the inner volume can be evacuated of a fluid medium, such that the casing is moldable when the bladder is not evacuated, and maintains a resilient shape when the bladder is evacuated;

the plurality of beads are distributed in the fluid medium within the inner volume;

in use, with the inner volume of the bladder not evacuated a displacing structure disposed on a surface of the casing causes a displacement of at least a portion of the fluid medium and at least a portion of the plurality of beads in the inner volume of the bladder and when evacuated, the bladder compresses the plurality of beads to maintain a shape of the displacement by the displacing structure;

an evacuation header having one or more fluid pump line interfaces configured to couple to one or more fluid pump lines, the evacuation header comprising an inner chamber for receiving liquid drained from a top surface of the bladder;

one or more evacuation paths through the bladder configured to drain fluid from a top surface of the bladder to the inner chamber; and a pump operatively associated with at least one of the one or more fluid pump lines, wherein the pump is configured to evacuate the evacuation header.

2. The moldable mattress of claim 1 wherein the casing in a plan view has a hemispheric egg-shape.

3. The moldable mattress of claim 1, the casing further comprising an outer skirt attached to and encircling the casing, wherein the outer skirt is configured to be flipped up creating a reservoir around an outer perimeter of the casing above the compliant surface or flipped down.

4. The moldable mattress of claim 1 in combination with a gimballing base, the gimballing base comprising:

a movable base having a telescoping post;

a gimballing plate;

a gimbal connection between the gimballing plate and a distal end of the telescoping post configured to gimbal about 2 axes.

5. The moldable mattress of claim 1, wherein the casing further comprises a compliant layer over the top surface of the bladder, wherein the compliant surface is configured to conform to a shape of the displacing structure.

6. The moldable mattress of claim 1 wherein the one or more evacuation paths are defined at least in part by the bladder.

7. The moldable mattress of claim 1 wherein the one or more evacuation paths is one or more evacuation tubes defined at least in part by the bladder.

8. The moldable mattress of claim 7 further comprising reinforcement in the evacuation tubes to resist collapsing.

9. The moldable mattress of claim 1 wherein the evacuation header underlies the bladder.

10. The moldable mattress of claim 1 further comprising a pump operatively associated with at least one of the one or more fluid pump lines, the pump having an outlet attached to an evacuation fluid pump line, the evacuation fluid pump line being coupled to a sanitizing trap, wherein the sanitizing trap holds a sanitizing and deodorizing solution to disinfect and deodorize the recovered liquid waste, water, and any circulating air.

11. The moldable mattress of claim 1 wherein the bladder is impermeable.

12. The moldable mattress of claim 1 wherein the bladder is made of a woven material.

13. The moldable mattress of claim 12 wherein the bladder is permeable.

14. The moldable mattress of claim 12 wherein the fluid medium is air and the bladder is permeable.

* * * * *